US008177923B2

(12) United States Patent
Ohta et al.

(10) Patent No.: US 8,177,923 B2
(45) Date of Patent: May 15, 2012

(54) NANO-CRYSTALLINE, MAGNETIC ALLOY, ITS PRODUCTION METHOD, ALLOY RIBBON AND MAGNETIC PART

(75) Inventors: Motoki Ohta, Kumagaya (JP); Yoshihito Yoshizawa, Fukaya (JP)

(73) Assignee: Hitachi Metals, Ltd., Tokyo (JP)

( * ) Notice: Subject to any disclaimer, the term of this patent is extended or adjusted under 35 U.S.C. 154(b) by 419 days.

(21) Appl. No.: 12/066,595

(22) PCT Filed: Sep. 19, 2006

(86) PCT No.: PCT/JP2006/318540

§ 371 (c)(1), (2), (4) Date: Mar. 12, 2008

(87) PCT Pub. No.: WO2007/032531

PCT Pub. Date: Mar. 22, 2007

(65) Prior Publication Data

US 2009/0266448 A1 Oct. 29, 2009

(30) Foreign Application Priority Data

Sep. 16, 2005 (JP) ..... 2005-270432

(51) Int. Cl.
*H01F 1/147* (2006.01)

(52) U.S. Cl. ..... 148/311; 148/306; 148/307; 148/310

(58) Field of Classification Search ..... None
See application file for complete search history.

(56) References Cited

U.S. PATENT DOCUMENTS

| | | | | |
|---|---|---|---|---|
| 4,473,400 | A | 9/1984 | Hoselitz | |
| 5,211,767 | A | 5/1993 | Shigeta et al. | |
| 5,522,948 | A * | 6/1996 | Sawa et al. | 148/308 |
| 6,425,960 | B1 | 7/2002 | Yoshizawa et al. | |
| 2001/0022208 | A1 * | 9/2001 | Perepezko et al. | 148/561 |

FOREIGN PATENT DOCUMENTS

| | | | |
|---|---|---|---|
| JP | 64-079342 | A | 3/1989 |
| JP | 01-156451 | A | 6/1989 |
| JP | 01-242755 | A | 9/1989 |
| JP | 2-022445 | | 1/1990 |
| JP | 05-140703 | A | 6/1993 |
| JP | 06-017204 | A | 1/1994 |
| JP | 2004-353090 | A | 12/2004 |
| JP | 2006-040906 | A | 2/2006 |
| WO | 82/03411 | | 10/1982 |
| WO | 02/77300 | A1 | 3/2002 |

OTHER PUBLICATIONS

XP 002585183. "Pressure Dependence of Nanocrystallization in Amorphous $Fe_{86}B_{14}$ and $Fe_{85}Cu_1B_{14}$ Alloys", B. Varga et al., vol. 286, No. 1, Jun. 30, 2000.

Supplementary European Search Report dated Jul. 14, 2010.

* cited by examiner

*Primary Examiner* — John Sheehan
(74) *Attorney, Agent, or Firm* — Sughrue Mion, PLLC

(57) ABSTRACT

A magnetic alloy having a composition represented by the general formula of $Fe_{100-x-y}Cu_xB_y$ (atomic %), wherein x and y are numbers meeting the conditions of $0.1 \leqq x \leqq 3$, and $10 \leqq y \leqq 20$, or the general formula of $Fe_{100-x-y-z}Cu_xB_yX_z$ (atomic %), wherein X is at least one element selected from the group consisting of Si, S, C, P, Al, Ge, Ga and Be, and x, y and z are numbers meeting the conditions of $0.1 \leqq x \leqq 3$, $10 \leqq y \leqq 20$, $0 < z \leqq 10$, and $10 < y+z \leqq 24$), the magnetic alloy having a structure containing crystal grains having an average diameter of 60 nm or less in an amorphous matrix, and a saturation magnetic flux density of 1.7 T or more.

27 Claims, 11 Drawing Sheets

NANO-CRYSTALLINE, MAGNETIC ALLOY, ITS PRODUCTION METHOD, ALLOY RIBBON AND MAGNETIC PART

This is a 371 of PCT/JP2006/318540 filed Sep. 19, 2006, claiming the priority of JP2005-270432 filed Sep. 16, 2005, both hereby incorporated by reference.

FIELD OF THE INVENTION

The present invention relates to a nano-crystalline, magnetic alloy having a high saturation magnetic flux density and excellent soft magnetic properties, particularly excellent AC magnetic properties, which is suitable for various magnetic parts, its production method, and an alloy ribbon and a magnetic part made of such a nano-crystalline, magnetic alloy.

BACKGROUND OF THE INVENTION

Magnetic materials used for various transformers, reactor choke coils, noise-reducing parts, pulse power magnetic parts for laser power sources and accelerators, motors, generators, etc. are silicon steel, ferrite, Co-based amorphous alloys, Fe-based, amorphous alloys, Fe-based, nano-crystalline alloys, etc., because they need high saturation magnetic flux density and excellent AC magnetic properties.

Silicon steel plates that are inexpensive and have a high magnetic flux density are extremely difficult to be made as thin as amorphous ribbons, and suffer large core loss at high frequencies because of large eddy current loss. Ferrite is unsuitably magnetically saturated in high-power applications needing a large operation magnetic flux density, because it has a small saturation magnetic flux density. The Co-based amorphous alloys have as low saturation magnetic flux density as 1 T or less, thereby making high-power parts larger. Their core loss increases with time because of thermal instability. Further, they are costly because Co is expensive.

As the Fe-based, amorphous alloy, JP 5-140703 A discloses an Fe-based, amorphous alloy ribbon for a transformer core having a composition represented by $(Fe_aSi_bB_cC_d)_{100-x}Sn_x$ (atomic %), wherein a is 0.80-0.86, b is 0.01-0.12, c is 0.06-0.16, d is 0.001-0.04, a+b+c+d=1, and x is 0.05-1.0, the alloy ribbon having excellent soft magnetic properties, such as good squareness, low coercivity, and large magnetic flux density. However, this Fe-based, amorphous alloy has a low saturation magnetic flux density, because the theoretical upper limit of the saturation magnetic flux density determined by interatomic distance, the number of coordination and the concentration of Fe is as low as about 1.65 T. It also has such large magnetostriction that its properties are easily deteriorated by stress. It further has a low S/N ratio in an audible frequency range. To increase the saturation magnetic flux density of the Fe-based, amorphous alloy, proposal has been made to substitute part of Fe with Co, Ni, etc., but its effect is insufficient despite high cost.

As the Fe-based, nano-crystalline alloy, JP 1-156451 A discloses a soft-magnetic, Fe-based, nano-crystalline alloy having a composition represented by $(Fe_{1-a}CO_a)_{100-x-y-z-\alpha}Cu_xSi_yB_zM'_\alpha$ (atomic %), wherein M' is at least one element selected from the group consisting of Nb, W, Ta, Zr, Hf, Ti and Mo, and a, x, y, z and α are numbers meeting the conditions of $0 \leqq a \leqq 0.3$, $0.1 \leqq x \leqq 3$, $3 \leqq y \leqq 6$, $4 \leqq z \leqq 17$, $10 \leqq y+z \leqq 20$, and $0.1 \leqq \alpha \leqq 5$, 50% or more of the alloy structure being occupied by crystal grains having an average diameter of 1000 angstrom or less. However, this Fe-based, nano-crystalline alloy has an unsatisfactory saturation magnetic flux density of about 1.5 T.

JP 2006-40906 A discloses a method for producing a soft magnetic ribbon comprising the steps of quenching an Fe-based alloy melt to form a 180°-bendable ribbon having a mixed phase structure, in which an α-Fe crystal phase having an average diameter of 50 nm or less is dispersed in an amorphous phase, and heating the ribbon to a temperature higher than the crystallization temperature of the α-Fe crystal phase. However, this soft magnetic ribbon has an unsatisfactory saturation magnetic flux density of about 1.6 T.

OBJECT OF THE INVENTION

Accordingly, an object of the present invention is to provide a nano-crystalline, magnetic alloy, which is inexpensive because of containing substantially no Co, and has as high a saturation magnetic flux density as 1.7 T or more as well as low coercivity and core loss, and its production method, and a ribbon and a magnetic part made of such a nano-crystalline, magnetic alloy.

DISCLOSURE OF THE INVENTION

Although it has been considered that completely amorphous alloys should be heat-treated for crystallization to obtain excellent soft magnetic properties, the inventors have found that in the case of an Fe-rich alloy, a nano-crystalline, magnetic alloy having a high saturation magnetic flux density as well as low coercivity and core loss can be obtained by producing an alloy having fine crystal grains dispersed in an amorphous phase, and then heat-treating the alloy. The present invention has been completed based on such finding.

Thus, the first magnetic alloy of the present invention has a composition represented by the following general formula (1):

$$Fe_{100-x-y}Cu_xB_y(\text{atomic }\%) \quad (1),$$

wherein x and y are numbers meeting the conditions of $0.1 \leqq x \leqq 3$, and $10 \leqq y \leqq 20$, the magnetic alloy having a structure containing crystal grains having an average diameter of 60 nm or less in an amorphous matrix, and a saturation magnetic flux density of 1.7 T or more.

The second magnetic alloy of the present invention has a composition represented by the following general formula (2):

$$Fe_{100-x-y-z}Cu_xB_yX_z(\text{atomic }\%) \quad (2),$$

wherein X is at least one element selected from the group consisting of Si, S, C, P, Al, Ge, Ga and Be, and x, y and z are numbers meeting the conditions of $0.1 \leqq x \leqq 3$, $10 \leqq y \leqq 20$, $0 < z \leqq 10$, and $10 < y+z \leqq 24$, the magnetic alloy having a structure containing crystal grains having an average diameter of 60 nm or less in an amorphous matrix, and a saturation magnetic flux density of 1.7 T or more. The X is preferably Si and/or P.

The crystal grains are preferably dispersed in an amorphous matrix in a proportion of 30% or more by volume. The magnetic alloy preferably has maximum permeability of 20,000 or more.

The first and second magnetic alloys preferably further contain Ni and/or Co in a proportion of 10 atomic % or less based on Fe. Also, the first and second magnetic alloys preferably further contain at least one element selected from the group consisting of Ti, Zr, Hf, V, Nb, Ta, Cr, Mo, W, Mn, Re, platinum-group elements, Au, Ag, Zn, In, Sn, As, Sb, Bi, Y, N, O and rare earth elements in a proportion of 5 atomic % or less based on Fe. The magnetic alloy is preferably in a ribbon, powder or flake shape.

The magnetic part of the present invention is made of the magnetic alloy.

The method of the present invention for producing a magnetic alloy comprises the steps of quenching an alloy melt comprising Fe and a metalloid element, which has a composition represented by the above general formula (1) or (2), to produce an Fe-based alloy having a structure in which crystal grains having an average diameter of 30 nm or less are dispersed in an amorphous matrix in a proportion of more than 0% by volume and 30% by volume or less, and heat-treating the Fe-based alloy to have a structure in which body-centered-cubic crystal grains having an average diameter of 60 nm or less are dispersed in an amorphous matrix in a proportion of 30% or more by volume.

DESCRIPTION OF THE PREFERRED EMBODIMENTS

Figure 1:
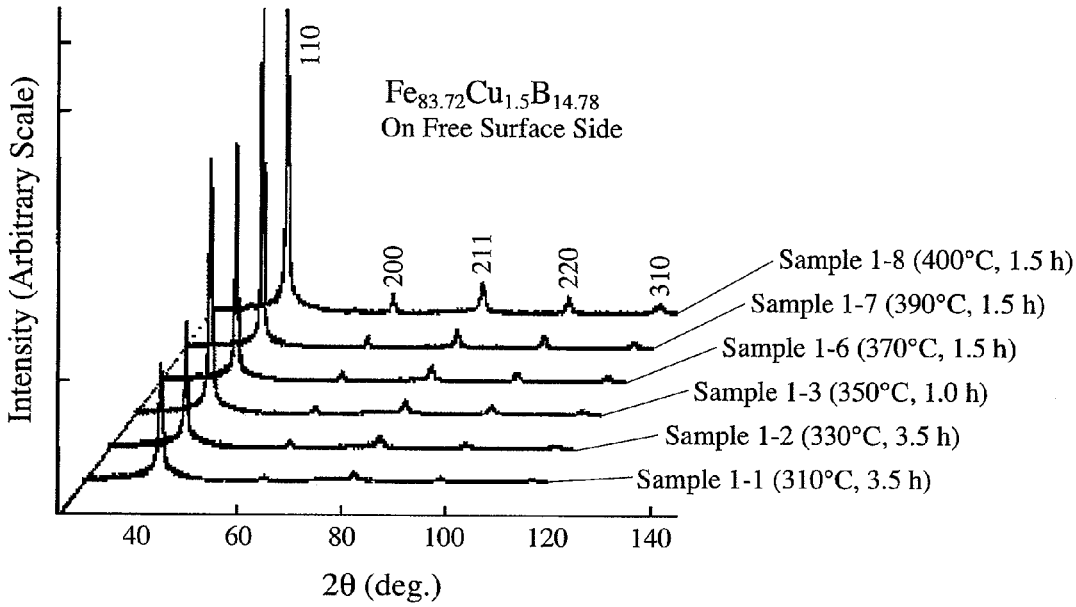
FIG. 1 is a graph showing the X-ray diffraction patterns of the alloy ($Fe_{83.72}Cu_{1.5}B_{14.78}$) of Example 1.

[1] Magnetic Alloy (1) Composition (a) First Magnetic Alloy

To have a saturation magnetic flux density Bs of 1.7 T or more, the magnetic alloy should have a structure containing fine bcc-Fe crystals. To this end, the magnetic alloy should have a high Fe concentration. Specifically, the Fe concentration of the magnetic alloy is about 75 atomic % (about 90% by mass) or more.

Accordingly, the first magnetic alloy should have a composition represented by the following general formula (1):

$$Fe_{100-x-y}Cu_xB_y(\text{atomic }\%) \quad (1),$$

wherein x and y are numbers meeting the conditions of $0.1 \leqq x \leqq 3$, and $10 \leqq y \leqq 20$. The saturation magnetic flux density of the magnetic alloy is 1.74 T or more when $0.1 \leqq x \leqq 3$ and $12 \leqq y \leqq 17$, 1.78 T or more when $0.1 \leqq x \leqq 3$ and $12 \leqq y \leqq 15$, and 1.8 T or more when $0.1 \leqq x \leqq 3$ and $12 \leqq y \leqq 15$.

The Cu content x is $0.1 \leqq x \leqq 3$. When the x exceeds 3 atomic %, it is extremely difficult to form an amorphous-phase-based ribbon by quenching, resulting in drastically deteriorated soft magnetic properties. When the x is less than 0.1 atomic %, fine crystal grains are not easily precipitated. The Cu content is preferably $1 \leqq x \leqq 2$, more preferably $1 \leqq x \leqq 1.7$, most preferably $1.2 \leqq x \leqq 1.6$. 3 atomic % or less of Cu may be substituted by Au and/or Ag.

The B content y is $10 \leqq y \leqq 20$. B is an indispensable element for accelerating the formation of the amorphous phase. When the y is less than 10 atomic %, it is extremely difficult to form an amorphous-phase-based ribbon. When the y exceeds 20 atomic %, the saturation magnetic flux density becomes 1.7 T or less. The B content is preferably $12 \leqq y \leqq 17$, more preferably $14 \leqq y \leqq 17$.

With Cu and B within the above ranges, a soft-magnetic, fine-crystalline, magnetic alloy having coercivity of 12 A/m or less can be obtained.

(b) Second Magnetic Alloy

The second magnetic alloy has a composition represented by the following general formula (2):

$$Fe_{100-x-y-z}Cu_xB_yX_z(\text{atomic }\%) \quad (2),$$

wherein X is at least one element selected from the group consisting of Si, S, C, P, Al, Ge, Ga and Be, and x, y and z are numbers meeting the conditions of $0.1 \leqq x \leqq 3$, $10 \leqq y \leqq 20$, $0 < z \leqq 10$, and $10 < y+z \leqq 24$. The addition of the X atom elevates a temperature from which the precipitation of Fe—B having large crystal magnetic anisotropy starts, thereby elevating the heat treatment temperature. A high-temperature heat treatment increases the percentage of fine crystal grains, resulting in increase in the saturation magnetic flux density Bs and improvement in the squareness ratio of a B-H curve. It also suppresses the degradation and discoloration of the magnetic alloy surface. The saturation magnetic flux density Bs is 1.74 T or more when $0.1 \leqq x \leqq 3$, $12 \leqq y \leqq 17$, $0 < z \leqq 7$, and $13 \leqq y+z \leqq 20$, 1.78 T or more when $0.1 \leqq x \leqq 3$, $12 \leqq y \leqq 15$, $0 < z \leqq 5$, and $14 \leqq y+z \leqq 19$, and 1.8 T or more when $0.1 \leqq x \leqq 3$, $12 \leqq y \leqq 15$, $0 < z \leqq 4$, and $14 \leqq y+z \leqq 17$.

(c) Amounts of Ni and Co

In the first and second magnetic alloys, the substitution of part of Fe by Ni and/or Co soluble in Fe and Cu increases the amorphous phase formability, and enables the amount of Cu accelerating the precipitation of fine crystal grains to increase, thereby improving soft magnetic properties such as a saturation magnetic flux density, etc. However, the inclusion of large amounts of these elements leads to a higher cost. Accordingly, Ni is preferably 10 atomic % or less, more preferably 5 atomic % or less, most preferably 2 atomic % or less. Co is preferably 10 atomic % or less, more preferably 2 atomic % or less, most preferably 1 atomic % or less.

(d) Other Elements

In the first and second magnetic alloys, part of Fe may be substituted by at least one element selected from the group consisting of Ti, Zr, Hf, V, Nb, Ta, Cr, Mo, W, Mn, Re, platinum-group elements, Au, Ag, Zn, In, Sn, As, Sb, Bi, Y, N, O and rare earth elements. Because these substituting elements predominantly enter the amorphous phase together with Cu and metalloid elements, the formation of fine bcc-Fe crystal grains is accelerated, resulting in improvement in soft magnetic properties. Too much inclusion of these substituting elements having large atomic numbers ensues too low a mass ratio of Fe, inviting decrease in the magnetic properties of the magnetic alloy. Accordingly, the amount of the substituting element is preferably 5 atomic % or less based on Fe. Particularly in the case of Nb and Zr, the amount of the substituting element is more preferably 2 atomic % or less based on Fe. In the case of Ta and Hf, the amount of the substituting element is more preferably 2.5 atomic % or less, particularly 1.2 atomic % or less, based on Fe. In the case of Mn, the amount of the substituting element is more preferably 2 atomic % or less based on Fe. To obtain a high saturation magnetic flux density, the total amount of the substituting elements is more preferably 1.8 atomic % or less, particularly 1 atomic % or less.

(2) Structure and Properties

The crystal grains having a body-centered-cubic (bcc) structure dispersed in the amorphous phase have an average diameter of 60 nm or less. The volume fraction of crystal grains is preferably 30% or more. When the average diameter of the crystal grains exceeds 60 nm, the soft magnetic properties of the magnetic alloy are deteriorated. When the volume fraction of crystal grains is less than 30%, the magnetic alloy has a low saturation magnetic flux density. The crystal grains preferably have an average diameter of 30 nm or less and a volume fraction of 50% or more.

The Fe-based crystal grains may contain Si, B, Al, Ge, Ga, Zr, etc., and may partially have a face-centered-cubic (fcc) phase of Cu, etc. To have as large core loss as possible, the amount of the compound phase should be as small as possible.

The magnetic alloy of the present invention is a soft magnetic alloy having as high a saturation magnetic flux density as 1.7 T or more (particularly 1.73 T or more), as low coercivity Hc as 200 A/m or less (further 100 A/m or less, particularly 24 A/m or less), as low core loss as 20 W/kg or less at 20 kHz and 0.2 T, and as high AC specific initial permeability μk as 3000 or more (particularly 5000 or more). Because the structure of the magnetic alloy of the present invention contains a large amount of fine bcc-Fe crystal grains, the magnetic alloy of the present invention has much smaller magnetostriction generated by the magnetic volume effect and a larger noise-reducing effect than those of the amorphous alloy having the same composition. The magnetic alloy of the present invention may be in a flake, ribbon, powder or film shape.

[2] Production Method

The production method of the magnetic alloy of the present invention comprises the steps of quenching an alloy melt comprising Fe and a metalloid element to produce an Fe-based alloy having a structure in which fine crystal grains having an average diameter of 30 nm or less are dispersed in a proportion of more than 0% by volume and 30% by volume or less in an amorphous matrix, and heat-treating the alloy ribbon to have a structure in which body-centered-cubic crystal grains having an average diameter of 60 nm or less are dispersed in an amorphous matrix in a proportion of 30% or more by volume.

(1) Alloy Melt

The alloy melt comprising Fe and a metalloid element has a composition represented by the following general formula (1):

$$Fe_{100-x-y}Cu_xB_y(\text{atomic }\%) \quad (1),$$

wherein x and y are numbers meeting the conditions of $0.1 \leqq x \leqq 3$, and $10 \leqq y \leqq 20$, or the following general formula (2):

$$Fe_{100-x-y-z}Cu_xB_yX_z(\text{atomic }\%) \quad (2),$$

wherein X is at least one element selected from the group consisting of Si, S, C, P, Al, Ge, Ga and Be, and x, y and z are numbers meeting the conditions of $0.1 \leqq x \leqq 3$, $10 \leqq y \leqq 20$, $0 < z \leqq 10$, and $10 < y+z \leqq 24$.

(2) Quenching of Melt

The quenching of the melt can be conducted by a single roll method, a double roll method, a spinning-in-rotating-liquid method, a gas-atomizing method, a water-atomizing method, etc. The quenching of the melt provides a fine crystalline alloy (intermediate alloy) in a flake, ribbon or powder shape. The temperature of the melt to be quenched is preferably higher than the melting point of the alloy by about 50-300° C. The quenching of the melt is conducted in the air or in an inert gas atmosphere such as Ar, nitrogen, etc. when the melt does not contain active metals, and in an inert gas such as Ar, He, nitrogen, etc. or under reduced pressure when the melt contains active metals.

In the case of the single roll method, there is preferably an inert gas atmosphere, for instance, near a tip end of a nozzle. Also, a $CO_2$ gas may be brown onto the roll, or a CO gas may be burned near the nozzle. The peripheral speed of a cooling roll is preferably 15-50 m/s, and materials for the cooling roll are preferably pure copper, or copper alloys such as Cu—Be, Cu—Cr, Cu—Zr, Cu—Zr—Cr, etc., which have high heat conductivity. The cooling roll is preferably a water-cooling type.

(3) Fine Crystalline Alloy (Intermediate Alloy)

The intermediate alloy obtained by quenching the alloy melt having the above composition has a structure in which fine crystal grains having an average diameter of 30 nm or less are dispersed in an amorphous phase in a proportion of more than 0% by volume and 30% by volume or less. When there is an amorphous phase around the crystal grains, the alloy has high resistivity, and suppresses the growth of the crystal grains to make the crystal grains finer, thereby improving soft magnetic properties. When the fine crystal grains in the intermediate alloy have an average diameter of more than 30 nm, the crystal grains become too coarse by the heat treatment, resulting in the deterioration of the soft magnetic properties. To obtain excellent soft magnetic properties, the crystal grains preferably have an average diameter of 20 nm or less. Because there should be fine crystal grains acting as nuclei in the amorphous phase, the average diameter of the crystal grains is preferably 0.5 nm or more. An average distance between the crystal grains (distance between the centers of gravity of crystals) is preferably 50 nm or less. When the average distance is more than 50 nm, the diameter distribution of the crystal grains becomes too wide by the heat treatment.

(4) Heat Treatment

When the Fe-rich intermediate alloy is heat-treated, the volume fraction of crystal grains increases without suffering extreme increase in the diameter, resulting in a magnetic alloy having better soft magnetic properties than those of the Fe-based, amorphous alloy and the Fe-based, nano-crystalline alloy. Specifically, the heat treatment turns the intermediate alloy to a magnetic alloy having a high saturation magnetic flux density and low magnetostriction, which contains 30% by volume of fine crystal grains having an average diameter of 60 nm or less. By adjusting the temperature and time of the heat treatment, the formation of crystal nuclei and the growth of crystal grains can be controlled. A heat treatment at a high temperature (about 430° C. or higher) for a short period of time is effective to obtain low coercivity, improving a magnetic flux density in a weak magnetic field and reducing hysteresis loss. A heat treatment at a low temperature (about 350° C. or higher and lower than 430° C.) for a long period of time is suitable for mass production. A high-temperature, short heat treatment or a low-temperature, long heat treatment may be used depending on the desired magnetic properties.

The heat treatment is conducted preferably in the air, in vacuum or in an inert gas such as Ar, He, $N_2$, etc. Because moisture in the atmosphere provides the resultant magnetic alloy with uneven magnetic properties, the dew point of the inert gas is preferably −30° C. or lower, more preferably −60° C. or lower.

The heat treatment may be conducted by a single stage or many stages. Further, DC current, AC current or pulse current may be supplied to the alloy to generate a Joule heat for the heat treatment, or the heat treatment may be conducted under stress.

(a) High-temperature Heat Treatment

The Fe-based intermediate alloy (containing about 75 atomic % or more of Fe) containing fine crystal grains in an amorphous phase is subjected to a heat treatment comprising heating to the highest temperature of 430° C. or higher at the maximum temperature-elevating speed of 100° C./minute or more, and keeping the highest temperature for 1 hour or less, to produce a magnetic alloy containing fine crystal grains having an average diameter of 60 nm or less, and having low coercivity, a high magnetic flux density in a weak magnetic field, and small hysteresis loss.

When the highest temperature is lower than 430° C., the precipitation and growth of fine crystal grains are insufficient. The highest temperature is preferably $(T_{X2}-50)$° C. or higher, wherein $T_{X2}$ is a compound-precipitating temperature.

When the time of holding the highest temperature is longer than 1 hour, the crystal grains grow too much, resulting in the deterioration of soft magnetic properties. The keeping time is preferably 30 minutes or less, more preferably 20 minutes or less, most preferably 15 minutes or less.

The average temperature-elevating speed is preferably 100° C./minute or more. Because the temperature-elevating speed largely affects the magnetic properties at high temperatures of 300° C. or higher, the temperature-elevating speed at 300° C. or higher is preferably 150° C./minute or more, and the temperature-elevating speed at 350° C. or higher is preferably 170° C./minute or more.

By the change of the temperature-elevating speed and the stepwise change of the holding temperature, the formation of crystal nuclei can be controlled. A uniform, fine crystal structure can be obtained by a heat treatment comprising holding the alloy at a temperature lower than the crystallization temperature for sufficient time, and then holding it at a temperature equal to or higher than the crystallization temperature for as short time as 1 hour or less. This appears to be due to the fact that crystal grains suppress their growth each other. In a preferred example, the alloy is kept at about 250° C. for more than 1 hour, heated at a speed of 100° C./minute or more at 300° C. or higher, and kept at the highest temperature of 430° C. or higher for 1 hour or less.

(b) Low-Temperature Heat Treatment

The intermediate alloy is kept at the highest temperature of about 350° C. or higher and lower than 430° C. for 1 hour or more. From the aspect of mass production, the keeping time is preferably 24 hours or less, more preferably 4 hours or less. To suppress increase in the coercivity, the average temperature-elevating speed is preferably 0.1-200° C./minute, more preferably 0.1-100° C./minute.

(c) Heat Treatment in Magnetic Field

To have inductive magnetic anisotropy, the alloy is preferably heat-treated in a sufficient magnetic field for saturation. The magnetic field may be applied during an entire period or only a certain period of the heat treatment comprising temperature elevation, keeping of a constant temperature and cooling, but it is preferably applied at a temperature of 200° C. or higher for 20 minutes or more. To obtain a DC or AC hysteresis loop having the desired shape, a magnetic field is preferably applied during the entire heat treatment to impart inductive magnetic anisotropy in one direction. In the case of a core formed by the alloy ribbon, it is preferable that a magnetic field of 8 $kAm^{-1}$ or more is applied in the width direction (height direction in the case of a ring-shaped core), and that a magnetic field of 80 $Am^{-1}$ or more is applied in the longitudinal direction (magnetic path direction in the case of the ring-shaped core), though depending on its shape. When a magnetic field is applied in a longitudinal direction of the alloy ribbon, the resultant magnetic alloy has a DC hysteresis loop having a high squareness ratio. When a magnetic field is applied in a width direction of the alloy ribbon, the resultant magnetic alloy has a DC hysteresis loop having a low squareness ratio. The magnetic field may be any one of DC, AC and pulse. The heat treatment in a magnetic field produces a magnetic alloy with low core loss.

(5) Surface Treatment

The magnetic alloy of the present invention may be provided with an insulating layer by the coating or impregnation of $SiO_2$, MgO, $Al_2O_3$, etc., a chemical treatment, anodic oxidation, etc., if necessary. These treatments lower eddy current at high frequencies, reducing the core loss. This effect is particularly remarkable for a core formed by a smooth, wide alloy ribbon.

[3] Magnetic Parts

The magnetic parts made of the magnetic alloy of the present invention are usable for large-current reactors such as anode reactors, choke coils for active filters, smoothing choke coils, various transformers such as pulse transformers for transmission, pulse power magnetic parts for laser power sources and accelerators, motor cores, generator cores, magnetic sensors, current sensors, antenna cores, noise-reducing parts such as magnetic shields and electromagnetic shields, yokes, etc.

The present invention will be explained in more detail with reference to Examples below without intention of restricting the scope of the present invention.

Example 1

An alloy ribbon (Sample 1-0) of 5 mm in width and 18 μm in thickness obtained from an alloy melt having a composition represented by $Fe_{83.72}Cu_{1.5}B_{14.78}$ (atomic %) by a single-roll quenching method was heat-treated at a temperature-elevating speed of 50° C./minute under the conditions shown in Table 1, to produce magnetic alloys (Samples 1-1 to 1-8). Each Sample was measured with respect to X-ray diffraction, the volume fraction of crystal grains and magnetic properties. The measurement results of magnetic properties are shown in Table 1.

(1) X-ray Diffraction Measurement

FIG. 1 shows the X-ray diffraction pattern of each sample. Although the diffraction of α-Fe was observed under any heat treatment conditions, it was confirmed from the half-width of a peak of a (310) plane obtained by the X-ray diffraction measurement that there was no lattice strain. The average crystal diameter was determined by the formula of Scherrer. There was a clear peak particularly when the heat treatment temperature (highest temperature) $T_A$ was 350° C. or higher. In Sample 1-7 ($T_A$=390° C.), for instance, the half-width of a peak of a (310) plane was about 2°, and the average crystal diameter was about 24 nm.

(2) Volume Fraction of Crystal Grains

An arbitrary line (length: Lt) was drawn on a TEM photograph of each sample to determine the total length Lc of portions crossing the crystal grains, and Lc/Lt was regarded as the volume fraction of crystal grains. It was thus found that crystal grains having an average diameter of 60 nm or less were dispersed at a volume ratio of 50% or more in an amorphous phase in each sample.

(3) Measurement of Magnetic Properties

Figure 2:
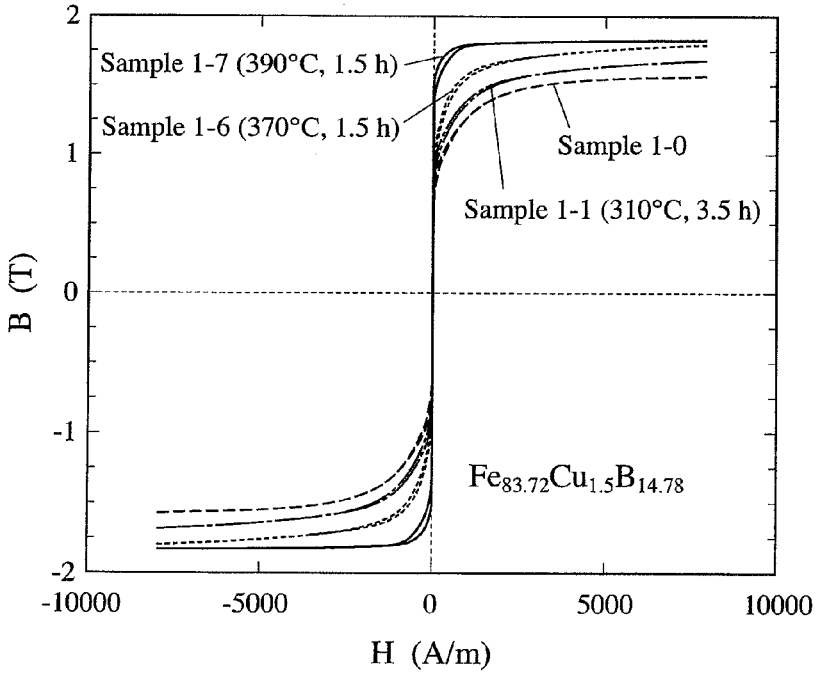
FIG. 2 is a graph showing the dependency of the magnetic flux density of the alloy ($Fe_{83.72}Cu_{1.5}B_{14.78}$) of Example 1 on a magnetic field.

A 12-cm-long plate was cut out of each sample, and its magnetic properties were measured by a B-H tracer. FIG. 2 shows the B-H curve of each sample. A higher heat treatment temperature provided better saturation resistance, resulting in higher $B_{8000}$. The $B_{8000}$ was 1.80 T or more at a heat treatment temperature $T_A$ of 350° C. or higher. Table 1 shows the heat treatment conditions, coercivity $H_C$, residual magnetic flux density $B_r$, magnetic flux densities $B_{80}$ and $B_{8000}$ at 80 A/m and 8000 A/m, and maximum permeability $\mu_m$ of each sample. The heat treatment changed the coercivity $H_C$ from about 7.8 A/m to 7 to 10 A/m. The heat treatment at $T_A$=390° C. for 1.5 hours provided Sample 1-7 with coercivity $H_C$ of 7.0 A/m. Sample 1-7 had $B_{8000}$ of 1.82 T. The heat treatment in a magnetic field increased the maximum permeability $\mu_m$.

TABLE 1

| Sample No. | Composition (atomic %) | Heat Treatment Conditions: Temp. (° C.) | Time (h) | Magnetic Field | $H_C$ (A/m) | $B_r$ (T) | $B_{80}$ (T) | $B_{8000}$ (T) | $\mu_m$ ($10^3$) |
|---|---|---|---|---|---|---|---|---|---|
| 1-0* | $Fe_{83.72}Cu_{1.5}B_{14.78}$ | — | — | — | 7.8 | 0.67 | 0.80 | 1.60 | 10 |
| 1-1 | $Fe_{83.72}Cu_{1.5}B_{14.78}$ | 310 | 3.50 | Yes | 13.1 | 0.83 | 0.95 | 1.71 | 24 |
| 1-2 | $Fe_{83.72}Cu_{1.5}B_{14.78}$ | 330 | 3.50 | Yes | 9.0 | 0.93 | 1.06 | 1.80 | 45 |
| 1-3 | $Fe_{83.72}Cu_{1.5}B_{14.78}$ | 350 | 1.00 | No | 9.4 | 0.91 | 1.06 | 1.83 | 31 |
| 1-4 | $Fe_{83.72}Cu_{1.5}B_{14.78}$ | 350 | 1.00 | Yes | 8.8 | 0.92 | 1.09 | 1.79 | 48 |
| 1-5 | $Fe_{83.72}Cu_{1.5}B_{14.78}$ | 350 | 3.00 | No | 13.8 | 0.92 | 1.17 | 1.82 | 26 |
| 1-6 | $Fe_{83.72}Cu_{1.5}B_{14.78}$ | 370 | 1.50 | Yes | 7.9 | 1.04 | 1.28 | 1.81 | 79 |
| 1-7 | $Fe_{83.72}Cu_{1.5}B_{14.78}$ | 390 | 1.50 | No | 7.0 | 1.29 | 1.52 | 1.82 | 60 |
| 1-8 | $Fe_{83.72}Cu_{1.5}B_{14.78}$ | 400 | 1.50 | Yes | 9.8 | 1.41 | 1.54 | 1.81 | 71 |

Note:
*Before heat treatment.

Figure 3:
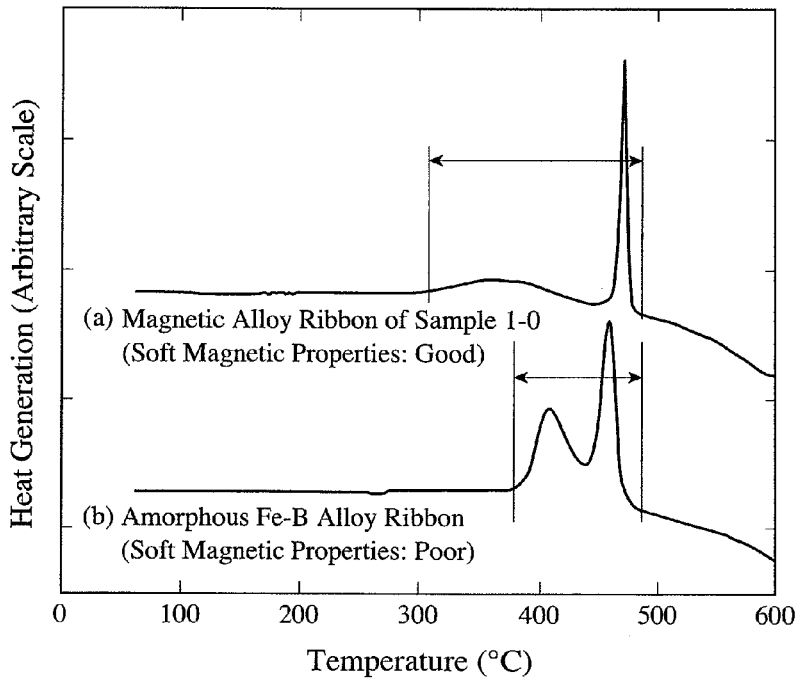
FIG. 3 is a graph showing the heat generation patterns of the magnetic alloy of the present invention and an Fe—B amorphous alloy.

FIG. 3 shows the differential scanning calorimetry results (temperature-elevating speed: 1° C./minute) of the magnetic alloy (a) of Sample 1-0 (composition: $Fe_{bal.}Cu_{1.5}B_{14.78}$), and an amorphous $Fe_{85}B_{15}$ alloy (b). In the magnetic alloy (a) of Sample 1-0, there was a broad heat generation peak in a low-temperature region, and a sharp heat generation peak by the precipitation of an Fe—B compound appeared in a high-temperature region. This is a typical heat generation pattern of the soft magnetic alloy of the present invention. It is presumed that the precipitation and growth of fine crystals occurred in a wide low-temperature range in which a broad heat generation peak appeared. As a result, small crystal grains with a narrow diameter distribution were formed, contributing to reduce the coercivity of the soft magnetic alloy while improving its saturation magnetic flux density. In the amorphous $Fe_{85}B_{15}$ alloy (b), however, rapid crystallization occurred in a low-temperature region in which a slightly broad heat generation peak appeared, resulting in coarse crystal grains and a large diameter distribution disadvantageous to soft magnetic properties.

Example 2

An alloy ribbon (Sample 2-0) of 5 mm in width and 18 μm in thickness obtained from an alloy melt having a composition represented by $Fe_{82.72}Ni_1Cu_{1.5}B_{14.78}$ (atomic %) by a single-roll quenching method was heat-treated at a temperature-elevating speed of 50° C./minute under the conditions shown in Table 2, to produce magnetic alloys of Samples 2-1 to 2-4. Each sample was measured with respect to X-ray diffraction and magnetic properties. The measurement results of magnetic properties are shown in Table 2.

Figure 4:
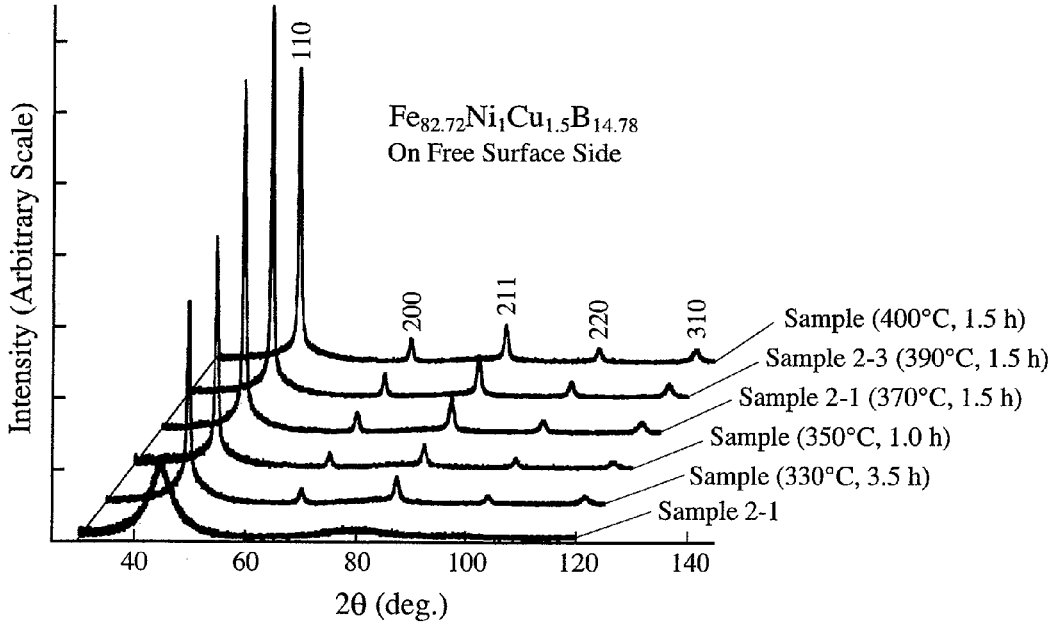
FIG. 4 is a graph showing the X-ray diffraction patterns of the alloy ($Fe_{82.72}Ni_1Cu_{1.5}B_{14.78}$) of Example 2.

FIG. 4 shows the X-ray diffraction pattern of each sample. When the heat treatment temperature $T_A$ was low, there was a diffraction pattern in which a halo by the amorphous phase and peaks by crystal grains having a body-centered-cubic structure (bcc) were overlapping, but as the $T_A$ was elevated, the amorphous phase decreased, leaving the peaks of the crystal grains predominant. The average crystal diameter determined from the half-width of a peak of a (310) plane (=about 1.5°) was about 32 nm, slightly larger than that of the magnetic alloy ($Fe_{83.72}Cu_{1.5}B_{14.78}$) of Example 1, which did not contain Ni.

Figure 5:
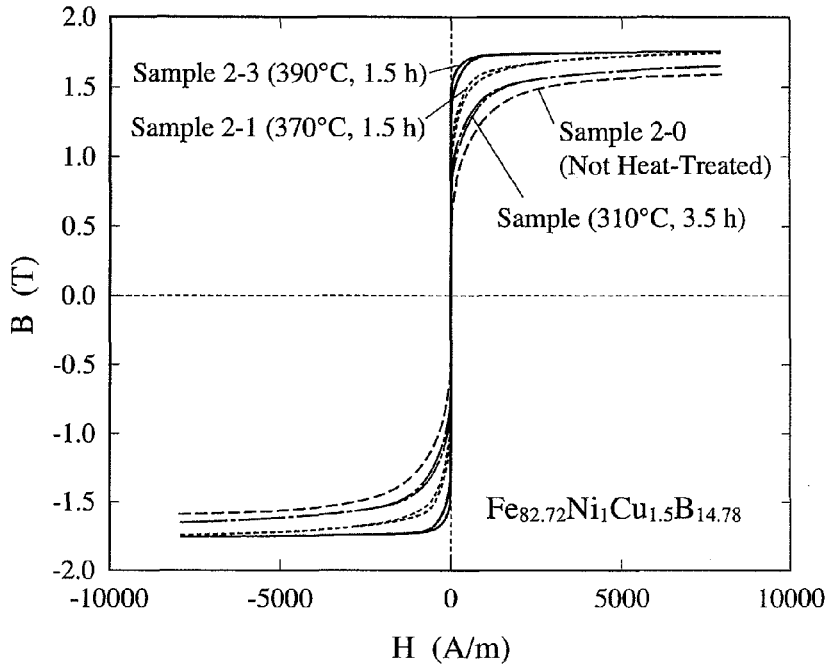
FIG. 5 is a graph showing the dependency of the magnetic flux density of the alloy ($Fe_{82.72}Ni_1Cu_{1.5}B_{14.78}$) of Example 2 on a magnetic field.

The B-H curves of each sample determined in the same manner as in Example 1 are shown in FIG. 5. Table 2 shows the heat treatment conditions and magnetic properties of each sample. As the heat treatment temperature $T_A$ was elevated, the saturation magnetic flux density ($B_{8000}$) increased. The best saturation resistance was obtained particularly at a heat treatment temperature of 390° C. (Sample 2-3). Sample 2-3 also had large $B_{80}$ (maximum 1.54 T), with good rising of a magnetic flux density in a weak magnetic field. The coercivity $H_C$ was relatively as low as about 7.8 A/m in a wide heat treatment temperature range of 370-390° C. The alloy ribbon of Example 2 was more resistant to breakage during production than that of Example 1 containing no Ni. This appears to be due to the fact that the composition of Example 2 was more likely to be made amorphous. Because Ni is dissolved in both Fe and Cu, the addition of Ni seems to be effective to improve the thermal stability of magnetic properties.

TABLE 2

| Sample No. | Composition (atomic %) | Heat Treatment Conditions Temp. (° C.) | Time (h) | Magnetic Field | $H_C$ (A/m) | $B_r$ (T) | $B_{80}$ (T) | $B_{8000}$ (T) | $\mu_m$ ($10^3$) |
|---|---|---|---|---|---|---|---|---|---|
| 2-0* | $Fe_{82.72}Ni_1Cu_{1.5}B_{14.78}$ | — | — | — | 10.5 | 0.49 | 0.68 | 1.62 | 8 |
| 2-1 | $Fe_{82.72}Ni_1Cu_{1.5}B_{14.78}$ | 370 | 1.50 | Yes | 7.9 | 1.06 | 1.28 | 1.83 | 66 |
| 2-2 | $Fe_{82.72}Ni_1Cu_{1.5}B_{14.78}$ | 380 | 1.50 | Yes | 7.7 | 1.30 | 1.54 | 1.84 | 69 |
| 2-3 | $Fe_{82.72}Ni_1Cu_{1.5}B_{14.78}$ | 390 | 1.50 | No | 7.8 | 1.33 | 1.52 | 1.84 | 66 |
| 2-4 | $Fe_{82.72}Ni_1Cu_{1.5}B_{14.78}$ | 410 | 0.50 | Yes | 8.8 | 1.32 | 1.53 | 1.85 | 68 |

Note:
*Before heat treatment.

Example 3

An alloy ribbon of 5 mm in width and 20 μm in thickness (Sample 3-0) obtained from an alloy melt having a composition represented by $Fe_{83.5}Cu_{1.25}Si_1B_{14.25}$ (atomic %) by a single-roll quenching method in the atmosphere was heat-treated at a temperature-elevating speed of 50° C./minute under the conditions shown in Table 3, to produce the magnetic alloys of Samples 3-1 and 3-2. Similarly, the magnetic alloy of Sample 3-4 was produced from an alloy ribbon (Sample 3-3) having a composition represented by $Fe_{83.5}Cu_{1.25}B_{15.25}$, and the magnetic alloy of Sample 3-6 was produced from an alloy ribbon (Sample 3-5) having a composition represented by $Fe_{83.25}Cu_{1.5}Si_1B_{14.25}$. Each sample was measured with respect to X-ray diffraction, the volume fraction of crystal grains and magnetic properties. The measurement results of magnetic properties are shown in Table 3.

Figure 6:
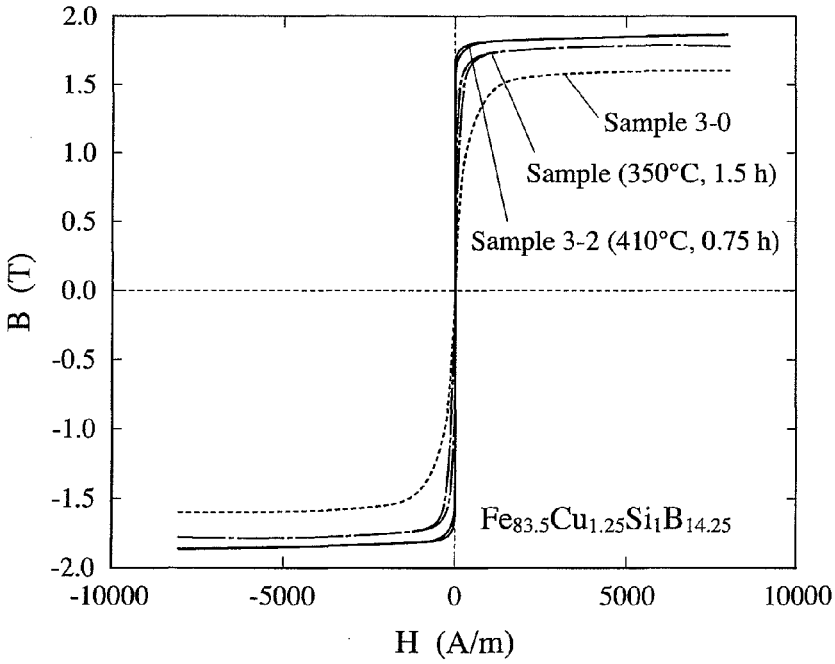
FIG. 6 is a graph showing dependency of the magnetic flux density of the alloy ($Fe_{83.5}Cu_{1.25}Si_1B_{14.25}$) of Example 3 on a magnetic field.

FIG. 6 shows the B-H curves of Samples 3-1 and 3-2. $B_{8000}$, which increased as the heat treatment temperature $T_A$ was elevated, was 1.85 T at $T_A$ of 410° C. (Sample 3-2), higher than that of each sample of Example 1 having a composition represented by $Fe_{83.5}Cu_{1.25}B_{15.25}$. This indicates that the magnetic alloy having a composition represented by $Fe_{83.5}Cu_{1.25}Si_1B_{14.25}$ had better saturation resistance.

Figure 7:
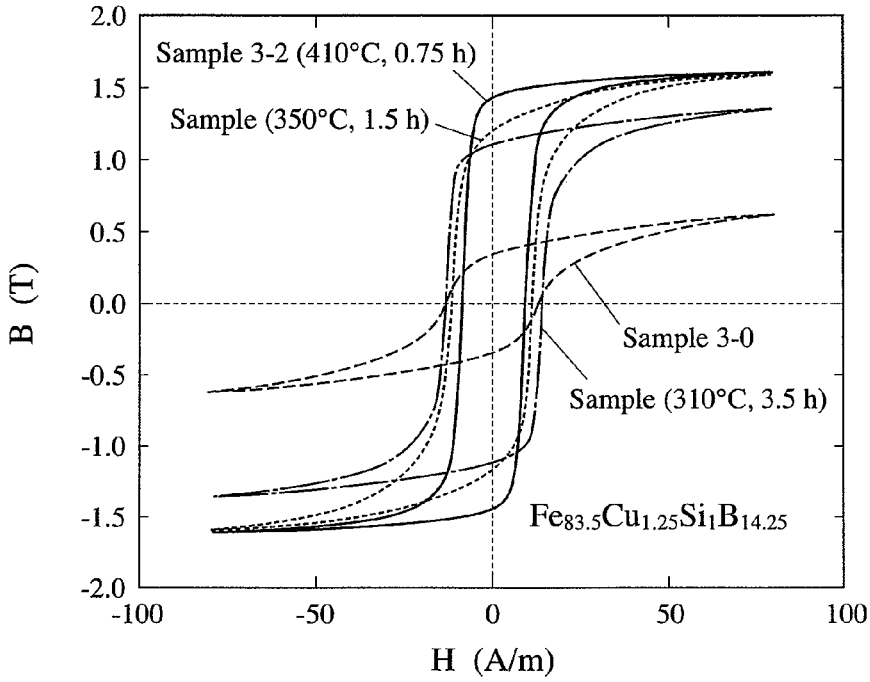
FIG. 7 is a graph showing the dependency of the magnetic flux density of the alloy ($Fe_{83.5}Cu_{1.25}Si_1B_{14.25}$) of Example 3 on a magnetic field.

FIG. 7 shows the B-H curve of each sample in a weak magnetic field. It was found that $B_{80}$ increased as the heat treatment temperature was elevated. At a heat treatment temperature $T_A$ of 410° C. (Sample 3-2), the $B_{80}$ was 1.65 T, the coercivity $H_C$ was as small as 8.6 A/m, and the ratio $B_r/B_{80}$ ($B_r$: residual magnetic flux density) was about 90%. Any of Samples 3-1 and 3-2 contained 50% or more by volume of crystal grains having an average diameter of 60 nm or less in an amorphous phase.

The magnetic alloy ($Fe_{83.5}Cu_{1.25}B_{15.25}$) of Sample 3-4 containing no Si had as high coercivity $H_C$ as about 16.4 A/m, poorer in soft magnetic properties than those of Samples 3-1 and 3-2 containing Si.

TABLE 3

| Sample No. | Composition (atomic %) | Heat Treatment Conditions Temp. (° C.) | Time (h) | Magnetic Field | $H_C$ (A/m) | $B_r$ (T) | $B_{80}$ (T) | $B_{8000}$ (T) | μm ($10^3$) |
|---|---|---|---|---|---|---|---|---|---|
| 3-0* | $Fe_{83.5}Cu_{1.25}Si_1B_{14.25}$ | — | — | — | 13.0 | 0.34 | 0.64 | 1.64 | 2 |
| 3-1 | $Fe_{83.5}Cu_{1.25}Si_1B_{14.25}$ | 400 | 1.50 | Yes | 9.8 | 1.36 | 1.60 | 1.84 | 67 |
| 3-2 | $Fe_{83.5}Cu_{1.25}Si_1B_{14.25}$ | 410 | 0.75 | Yes | 8.6 | 1.49 | 1.65 | 1.85 | 67 |
| 3-3* | $Fe_{83.5}Cu_{1.25}B_{15.25}$ | — | — | — | 28.5 | 0.67 | 0.85 | 1.79 | 12 |
| 3-4 | $Fe_{83.5}Cu_{1.25}B_{15.25}$ | 390 | 1.00 | No | 16.4 | 1.14 | 1.39 | 1.80 | 26 |
| 3-5* | $Fe_{83.25}Cu_{1.5}Si_1B_{14.25}$ | — | — | — | 20.3 | 0.39 | 0.54 | 1.60 | 3 |
| 3-6 | $Fe_{83.25}Cu_{1.5}Si_1B_{14.25}$ | 400 | 1.50 | Yes | 7.2 | 1.11 | 1.46 | 1.82 | 57 |

Note:
*Before heat treatment.

The evaluation results of the ribbon formability and soft magnetic properties of magnetic alloys having the same composition except for the presence of Si are shown in Table 4. It was found that the Si-containing magnetic alloys ($Fe_{83.5}Cu_{1.25}Si_1B_{14.25}$ and $Fe_{83.25}Cu_1S_{1.5}B_{14.25}$) had better ribbon formability and soft magnetic properties. This appears to be due to the fact that the inclusion of Si improved the formability of an amorphous phase.

TABLE 4

| Alloy Composition (atomic %) | Ribbon Formability | Soft Magnetic Properties |
|---|---|---|
| $Fe_{83.5}Cu_{1.25}B_{15.25}$ | Excellent | Good |
| $Fe_{83.5}Cu_{1.25}Si_1B_{14.25}$ | Excellent | Excellent |
| $Fe_{83.25}Cu_{1.5}B_{15.25}$ | Good | Good |
| $Fe_{83.25}Cu_1Si_{1.5}B_{14.25}$ | Excellent | Excellent |

Example 4

Figure 8:
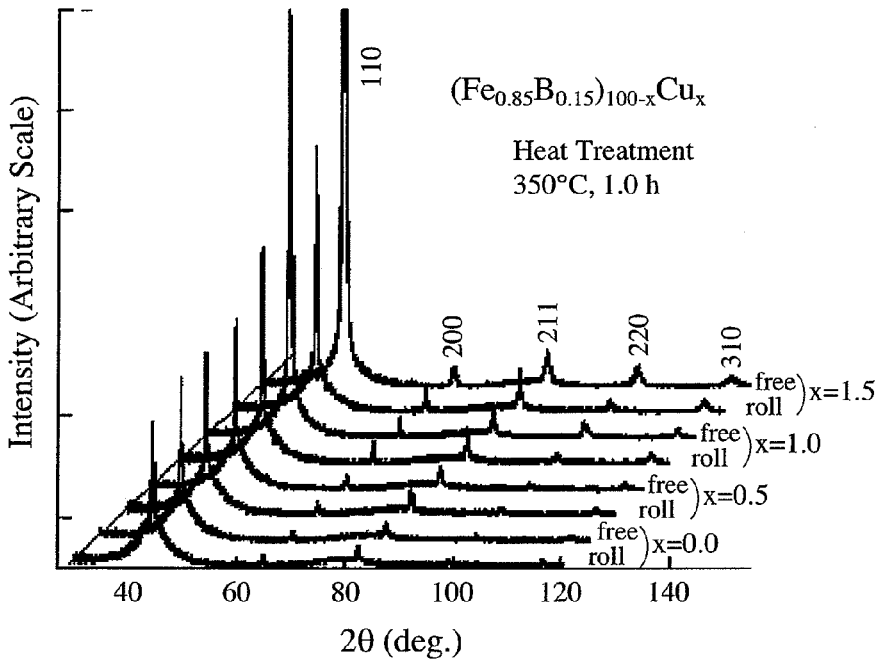
FIG. 8 is a graph showing the X-ray diffraction patterns of the alloy [$(Fe_{0.85}B_{0.15})_{100-x}Cu_x$] of Example 4.

Alloy ribbons of 5 mm in width and 18-22 μm in thickness obtained by a single-roll quenching method from four types of alloy melts represented by the general formula of $(Fe_{0.85}B_{0.15})_{100-x}Cu_x$ (atomic %), wherein the Cu concentration x was 0.0, 0.5, 1.0 and 1.5, respectively, were heat-treated under the conditions of a temperature-elevating speed of 50° C./minute, the highest temperature of 350° C. and a keeping time of 1 hour without a magnetic field. The X-ray diffraction and magnetic properties of each of the resultant magnetic alloys were measured in the same manner as in Example 1. FIG. 8 shows their X-ray diffraction patterns. In the figure, "roll" means the roll side of a ribbon, and "free" means the free surface side of a roll. Although there was a slightly larger peak intensity on the free surface side, there was no difference in a half-width. As the Cu concentration x increased, a halo by the amorphous phase decreased, making peaks by the bcc-crystals clearer. The magnetic alloy having a Cu concentration x of 1.5 had an average crystal diameter of about 24 nm. The comparison of magnetic alloys with x of 1.0 and 1.5, at which bcc phase peaks were clearly observed, indicates that a wider peak was obtained at x=1.5, and that the average diameter of crystal grains at x=1.5 was about half of that at x=1.0.

Figure 9:
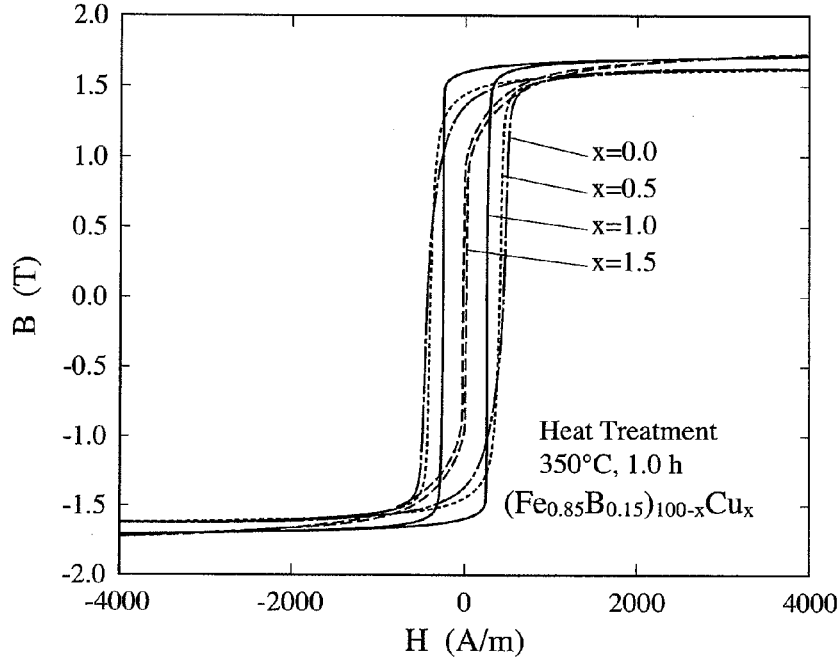
FIG. 9 is a graph showing the dependency of the magnetic flux density of the alloy [$(Fe_{0.85}B_{0.15})_{100-x}Cu_x$] of Example 4 on a magnetic field.

FIG. 9 shows the B-H curve. When x=0.0, the coercivity $H_C$ was about 400 A/m, and the saturation magnetic flux density $B_{8000}$ was about 1.63 T, but the crystal grain diameter did not increase with x, resulting in decrease in $H_C$ and increase in $B_{8000}$. When x=1.5, $H_C$ was about 10 A/m, and $B_{8000}$ was about 1.80 T. It was found that the addition of Cu reduced a crystal grain diameter and lowered coercivity even in an alloy having an Fe concentration of 80% or more.

Example 5

An alloy ribbon of 5 mm in width and 19-25 μm in thickness obtained from an alloy melt having the composition shown in Table 5 by a single-roll quenching method was heat-treated under the conditions of a temperature-elevating speed of 50° C./minute, the highest temperature of 410° C. and 420° C. and a keeping time of 1 hour without a magnetic field, to produce the magnetic alloys of Samples 5-1 to 5-4. Table 5 shows the heat treatment conditions and magnetic properties of these samples. Any sample had high $B_{80}$, a good squareness ratio ($B_r/B_{80}$) of 90% or more, extremely high maximum permeability $\mu_m$, a high crystallization temperature, and good amorphous phase formability. This indicates that larger amounts of metalloid elements such as B and Si lead to the improved soft magnetic properties. In any sample, 50% or more by volume of crystal grains having an average diameter of 60 nm or less were dispersed in an amorphous phase.

TABLE 5

| Sample No. | Composition (atomic %) | Heat Treatment Conditions Temp. (K) | Time (h) | $H_C$ (A/m) | $B_r$ (T) | $B_{80}$ (T) | $B_{8000}$ (T) | $\mu_m$ ($10^3$) |
|---|---|---|---|---|---|---|---|---|
| 5-1 | $Fe_{81.75}Cu_{1.25}Si_2B_{15}$ | 410 | 1.50 | 10.3 | 1.51 | 1.59 | 1.83 | 75 |
| 5-2 | $Fe_{81.75}Cu_{1.25}Si_3B_{14}$ | 410 | 1.50 | 8.0 | 1.53 | 1.64 | 1.83 | 101 |
| 5-3 | $Fe_{82.82}Cu_{1.25}Si_{1.76}B_{14.17}$ | 420 | 1.50 | 9.9 | 1.51 | 1.61 | 1.80 | 79 |
| 5-4 | $Fe_{82.72}Cu_{1.35}Si_{1.76}B_{14.17}$ | 420 | 1.50 | 6.5 | 1.60 | 1.66 | 1.85 | 108 |

Example 6

An alloy ribbon of 5 mm in width and 19-25 μm in thickness obtained from an alloy melt having the composition shown in Table 6 by a single-roll quenching method was heat-treated under the conditions of a temperature-elevating speed of 50° C./minute, the highest temperature of 410° C., and a keeping time of 1 hour without a magnetic field, to produce the magnetic alloys of Samples 6-1 to 6-30. Table 6 shows the thickness and magnetic properties of these samples. Any sample had $B_{8000}$ of 1.7 T or more and the maximum permeability $\mu_m$ as high as 30,000 or more, indicating good soft magnetic properties. It was found that the optimum amount of Cu changed as the metalloid element contents changed. Also, increase in the metalloid elements made it easy to produce a thick ribbon. In any sample, 50% or more by volume of crystal grains having an average diameter of 60 nm or less were dispersed in an amorphous phase.

TABLE 6

| Sample No. | Composition (atomic %) | Thickness (μm) | $B_{8000}$ (T) | $B_{80}$ (T) | $H_C$ (A/m) | $\mu_m$ ($10^3$) |
|---|---|---|---|---|---|---|
| 6-1 | $Fe_{bal.}Cu_{1.35}Si_4B_{12}$ | 19.9 | 1.81 | 1.57 | 15.8 | 41 |
| 6-2 | $Fe_{bal.}Cu_{1.5}Si_4B_{12}$ | 16.0 | 1.81 | 1.67 | 7.6 | 121 |
| 6-3 | $Fe_{bal.}Cu_{1.5}Si_5B_{12}$ | 17.0 | 1.78 | 1.65 | 7.8 | 92 |
| 6-4 | $Fe_{bal.}Cu_{1.5}Si_6B_{12}$ | 17.3 | 1.76 | 1.64 | 9.9 | 80 |
| 6-5 | $Fe_{bal.}Cu_{1.55}Si_7B_{12}$ | 16.8 | 1.75 | 1.62 | 9.8 | 74 |
| 6-6 | $Fe_{bal.}Cu_{1.6}Si_8B_{12}$ | 17.3 | 1.74 | 1.60 | 8.2 | 75 |
| 6-7 | $Fe_{bal.}Cu_{1.35}Si_3B_{13}$ | 21.0 | 1.84 | 1.67 | 7.9 | 96 |
| 6-8 | $Fe_{bal.}Cu_{1.35}Si_4B_{13}$ | 21.2 | 1.82 | 1.66 | 6.6 | 100 |
| 6-9 | $Fe_{bal.}Cu_{1.5}Si_5B_{13}$ | 17.2 | 1.79 | 1.67 | 6.2 | 127 |
| 6-10 | $Fe_{bal.}Cu_{1.6}Si_7B_{13}$ | 19.3 | 1.74 | 1.60 | 5.8 | 130 |
| 6-11 | $Fe_{bal.}Cu_{1.6}Si_8B_{13}$ | 18.8 | 1.71 | 1.58 | 6.9 | 62 |
| 6-12 | $Fe_{bal.}Cu_{1.6}Si_9B_{13}$ | 19.7 | 1.70 | 1.27 | 5.8 | 61 |
| 6-13 | $Fe_{bal.}Cu_{1.35}Si_2B_{14}$ | 18.0 | 1.85 | 1.71 | 6.5 | 120 |
| 6-14 | $Fe_{bal.}Cu_{1.35}Si_3B_{14}$ | 20.8 | 1.81 | 1.64 | 8.0 | 100 |
| 6-15 | $Fe_{bal.}Cu_{1.35}Si_4B_{14}$ | 21.8 | 1.77 | 1.62 | 7.1 | 109 |
| 6-16 | $Fe_{bal.}Cu_{1.5}Si_4B_{14}$ | 20.0 | 1.79 | 1.61 | 5.7 | 97 |
| 6-17 | $Fe_{bal.}Cu_{1.5}Si_5B_{14}$ | 17.3 | 1.79 | 1.63 | 8.8 | 105 |
| 6-18 | $Fe_{bal.}Cu_{1.5}Si_6B_{14}$ | 18.4 | 1.74 | 1.54 | 6.4 | 80 |
| 6-19 | $Fe_{bal.}Cu_{1.25}B_{15}$ | 16.2 | 1.83 | 1.41 | 8.0 | 72 |
| 6-20 | $Fe_{bal.}Cu_{1.35}Si_2B_{15}$ | 16.1 | 1.84 | 1.67 | 8.8 | 98 |
| 6-21 | $Fe_{bal.}Cu_{1.35}Si_3B_{15}$ | 19.3 | 1.79 | 1.62 | 7.1 | 100 |
| 6-22 | $Fe_{bal.}Cu_{1.5}Si_3B_{15}$ | 16.5 | 1.79 | 1.68 | 5.2 | 66 |
| 6-23 | $Fe_{bal.}Cu_{1.35}Si_4B_{15}$ | 21.7 | 1.79 | 1.65 | 6.8 | 117 |
| 6-24 | $Fe_{bal.}Cu_{1.5}Si_5B_{15}$ | 17.6 | 1.74 | 1.45 | 9.6 | 66 |
| 6-25 | $Fe_{bal.}Cu_{1.6}Si_6B_{15}$ | 19.5 | 1.70 | 1.55 | 8.2 | 63 |
| 6-26 | $Fe_{bal.}Cu_{1.5}Si_2B_{16}$ | 21.5 | 1.77 | 1.59 | 9.7 | 60 |
| 6-27 | $Fe_{bal.}Cu_{1.35}Si_3B_{16}$ | 19.9 | 1.76 | 1.60 | 16.6 | 45 |
| 6-28 | $Fe_{bal.}Cu_{1.6}Si_5B_{16}$ | 19.3 | 1.70 | 1.52 | 9.5 | 51 |
| 6-29 | $Fe_{bal.}Cu_{1.5}Si_2B_{18}$ | 21.3 | 1.71 | 1.37 | 13.6 | 33 |
| 6-30 | $Fe_{bal.}Cu_{1.6}Si_2B_{20}$ | 21.5 | 1.70 | 1.48 | 14.6 | 46 |

Example 7

An alloy ribbon obtained from an alloy melt having the composition of $Fe_{bal.}Cu_{1.5}SizBy$ by a single-roll quenching method was heat-treated at the changed highest temperatures under the conditions of a temperature-elevating speed of 50° C./minute and a keeping time of 1 hour without a magnetic field. A heat treatment temperature range within 5-% increase from the lowest coercivity $H_C$ was regarded as the optimum heat treatment temperature range.

Table 7 shows the optimum heat treatment temperature range for obtaining alloys having saturation magnetic flux densities Bs of 1.7 T or more. A higher heat treatment temperature leads to a larger amount of fine crystal grains precipitated, resulting in a higher magnetic flux density and better saturation resistance and squareness. The coercivity $H_C$ tended to increase as the Fe—B compound having large crystal magnetic anisotropy was precipitated. The larger the amount of B is, the more easily the Fe—B compound is precipitated at low temperatures. Because Si suppresses the precipitation of the Fe—B compound, it is preferable to add Si to obtain low coercivity.

TABLE 7

| Optimum heat treatment temperature range (° C.) | | | | | | | | | |
|---|---|---|---|---|---|---|---|---|---|
| | B | | | | | | | | |
| Si | 12 | 13 | 14 | 15 | 16 | 17 | 18 | 19 | 20 |
| 0 | —* | — | — | 370-390 | 370-390 | 370-390 | — | — | — |
| 1 | — | — | 390-410 | 390-410 | 390-410 | 390-410 | — | — | — |
| 2 | — | — | 410-430 | 410-430 | 410-430 | 410-420 | 410-420 | 410-420 | 410-420 |
| 3 | — | 410-430 | 410-430 | 410-430 | 410-430 | 410-430 | — | — | — |
| 4 | 410-430 | 410-430 | 410-430 | 410-430 | 410-430 | — | — | — | — |
| 5 | 410-430 | 410-430 | 410-430 | 410-430 | — | — | — | — | — |
| 6 | 410-440 | 410-440 | 410-440 | 410-430 | — | — | — | — | — |
| 7 | 410-440 | 410-440 | 410-440 | — | — | — | — | — | — |
| 8 | 410-440 | 410-440 | 410-440 | — | — | — | — | — | — |
| 9 | — | 410-440 | — | — | — | — | — | — | — |

Note:
*Not measured.

Example 8

Alloy ribbons of 5 mm in width and 18-22 μm in thickness obtained from P- or C-containing Fe—Cu—B alloy melts having the compositions shown in Table 8 by a single-roll quenching method were heat-treated under the conditions of a temperature-elevating speed of 50° C./minute, the highest temperatures of 370° C. and 390° C., and a keeping time of 1 hour without a magnetic field, to produce the magnetic alloys of Samples 8-1 to 8-4. Table 8 shows the thickness and magnetic properties of these samples. Any sample had $B_{8000}$ more than 1.7 T and the maximum permeability $\mu_m$ more than 30,000, indicating good soft magnetic properties. P and C improve the amorphous phase formability and ribbon toughness. In any sample, 50% or more by volume of crystal grains having an average diameter of 60 nm or less were dispersed in an amorphous phase.

TABLE 8

| Sample No. | Composition (atomic %) | Thickness (μm) | $T_A$ (° C.) | $B_{8000}$ (T) | $B_{80}$ (T) | $H_C$ (A/m) | $\mu_m$ ($10^3$) |
|---|---|---|---|---|---|---|---|
| 8-1 | $Fe_{bal.}Cu_{1.35}B_{16}P_1$ | 21.5 | 370 | 1.71 | 1.06 | 12.2 | 38 |
| 8-2 | $Fe_{bal.}Cu_{1.35}B_{14}P_3$ | 19.7 | 370 | 1.73 | 1.28 | 8.2 | 60 |
| 8-3 | $Fe_{bal.}Cu_{1.35}B_{16}C_1$ | 18.2 | 390 | 1.74 | 1.27 | 13.8 | 38 |
| 8-4 | $Fe_{bal.}Cu_{1.35}B_{14}C_3$ | 17.9 | 390 | 1.73 | 1.30 | 17.5 | 40 |

Example 9

Alloy ribbons of 5 mm in width and 20 μm in thickness obtained from P-, C- or Ga-containing Fe—Cu—Si—B alloy melts having the compositions shown in Table 9 by a single-roll quenching method were heat-treated under the conditions of a temperature-elevating speed of 50° C./minute, the highest temperatures of 410° C. or 430° C., and a keeping time of 1 hour without a magnetic field, to produce the magnetic alloys of Samples 9-1 to 9-5. Table 9 shows the thickness, highest temperature and magnetic properties of these samples. Any sample had $B_{8000}$ more than 1.8 T and the maximum permeability $\mu_m$ of 100,000 or more, indicating good soft magnetic properties. The inclusion of P or C for improving the amorphous phase formability made it possible to produce thicker and tougher ribbons than the 18.0-μm-thick ribbon of the alloy ($Fe_{bal.}Cu_{1.35}Si_2B_{14}$) of Sample 6-13, which had the same composition except for P and C. Ga appears to have a function to decrease the coercivity. In any sample, 50% or more by volume of crystal grains having an average diameter of 60 nm or less were dispersed in an amorphous phase.

TABLE 9

| Sample No. | Composition (atomic %) | Thickness (μm) | $T_A$ (° C.) | $B_{8000}$ (T) | $B_{80}$ (T) | $H_C$ (A/m) | $\mu_m$ ($10^3$) |
|---|---|---|---|---|---|---|---|
| 9-1 | $Fe_{bal.}Cu_{1.35}Si_2B_{14}P_1$ | 19.7 | 430 | 1.81 | 1.65 | 9.5 | 101 |
| 9-2 | $Fe_{bal.}Cu_{1.35}Si_2B_{12}P_2$ | 20.4 | 410 | 1.81 | 1.68 | 8.4 | 102 |
| 9-3 | $Fe_{bal.}Cu_{1.35}Si_2B_{14}C_1$ | 22.0 | 430 | 1.81 | 1.64 | 7.2 | 120 |
| 9-4 | $Fe_{bal.}Cu_{1.35}Si_2B_{14}Ga_1$ | 20.1 | 410 | 1.82 | 1.62 | 5.9 | 101 |
| 9-5 | $Fe_{bal.}Cu_{1.35}Si_3B_{14}Ga_1$ | 18.1 | 410 | 1.82 | 1.68 | 6.1 | 100 |

Example 10

Alloy ribbons of 5 mm in width and 20 μm in thickness obtained from Ni-, Co- or Mn-containing Fe—Cu—Si—B alloy melts having the compositions shown in Table 10 by a single-roll quenching method were heat-treated under the conditions of a temperature-elevating speed of 50° C./minute, the highest temperature of 410° C., and a keeping time of 1 hour without a magnetic field, to produce the magnetic alloys of Samples 10-1 to 10-5. Table 10 shows the thickness, highest temperature and magnetic properties of these samples. The substitution of Fe with Ni improved the amorphous phase formability, making it easy to produce thicker ribbons than the 18.0-μm-thick ribbon of the alloy ($Fe_{bal.}Cu_{1.35}Si_2B_{14}$) of Sample 6-13, which had the same composition except for Ni. In any sample, 50% or more by volume of crystal grains having an average diameter of 60 nm or less were dispersed in an amorphous phase.

TABLE 10

| Sample No. | Composition (atomic %) | Thickness (μm) | $T_A$ (° C.) | $B_{8000}$ (T) | $B_{80}$ (T) | $H_C$ (A/m) | $\mu_m$ ($10^3$) |
|---|---|---|---|---|---|---|---|
| 10-1 | $Fe_{bal.}Ni_1Cu_{1.35}Si_2B_{14}$ | 20.0 | 410 | 1.83 | 1.62 | 9.5 | 64 |
| 10-2 | $Fe_{bal.}Ni_2Cu_{1.35}Si_2B_{14}$ | 20.2 | 410 | 1.81 | 1.63 | 8.4 | 79 |
| 10-3 | $Fe_{bal.}Co_1Cu_{1.35}Si_2B_{14}$ | 20.1 | 410 | 1.85 | 1.70 | 6.8 | 99 |
| 10-4 | $Fe_{bal.}Co_2Cu_{1.35}Si_2B_{14}$ | 21.2 | 410 | 1.87 | 1.71 | 7.4 | 101 |
| 10-5 | $Fe_{bal.}Mn_2Cu_{1.35}Si_2B_{14}$ | 20.5 | 410 | 1.79 | 1.61 | 8.0 | 70 |

Example 11

Alloy ribbons of 5 mm in width and 20-25 μm in thickness obtained from Nb-containing Fe—Cu—B or Fe—Cu—Si—B alloy melts having the compositions shown in Table 11 by a single-roll quenching method were heat-treated under the conditions of a temperature-elevating speed of 50° C./minute, the highest temperature of 410° C., and the keeping time shown in Table 11 without a magnetic field, to produce the magnetic alloys of Samples 11-1 to 11-4. Table 11 shows the heat treatment conditions and magnetic properties of these samples. Any sample had good squareness ratio ($B_r/B_{80}$). Even with Nb, an element for accelerating the formation of nano-crystalline grains, added in a small amount, the ribbon formability was improved. In any sample, 50% or more by volume of crystal grains having an average diameter of 60 nm or less were dispersed in an amorphous phase.

TABLE 11

| Sample No. | Composition (atomic %) | Heat Treatment Conditions Temp. (K) | Time (h) | $H_C$ A/m) | $B_r$ (T) | $B_{80}$ (T) | $B_{8000}$ (T) | μm ($10^3$) |
|---|---|---|---|---|---|---|---|---|
| 11-1 | $Fe_{82.25}Cu_{1.25}Nb_{0.5}Si_2B_{14}$ | 410 | 1.50 | 13.2 | 1.42 | 1.51 | 1.74 | 59 |
| 11-2 | $Fe_{81.75}Cu_{1.25}Nb_1Si_2B_{14}$ | 410 | 1.50 | 10.7 | 1.13 | 1.43 | 1.74 | 45 |
| 11-3 | $Fe_{82.25}Cu_{1.25}Nb_{0.5}B_{16}$ | 410 | 0.75 | 10.1 | 1.22 | 1.44 | 1.73 | 70 |
| 11-4 | $Fe_{81.75}Cu_{1.25}Nb_1B_{16}$ | 410 | 1.50 | 9.0 | 1.26 | 1.51 | 1.75 | 77 |

Example 12

Alloy ribbons of 5 mm in width and 17-25 g/m in thickness obtained from alloy melts having the compositions shown in Table 12 by a single-roll quenching method were rapidly heated at an average temperature-elevating speed of 100° C./minute or 200° C./minute to the highest temperature of 450-480° C., which was higher than the optimum temperature in the 1-hour heat treatment, kept at that temperature for 2-10 minutes, and quenched to room temperature to produce the magnetic alloys of Samples 13-1 to 13-33. The temperature-elevating speed at 350° C. or higher was about 170° C./minute. Table 12 shows the heat treatment conditions, thickness and magnetic properties of these samples.

Figure 10:
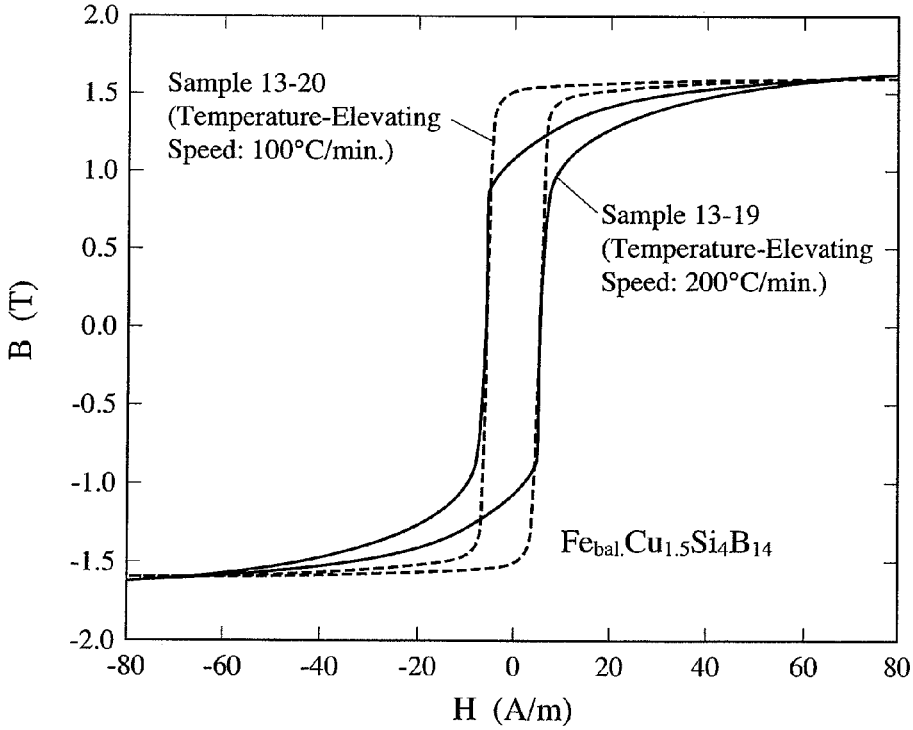
FIG. 10 is a graph showing the B-H curves of the alloys ($Fe_{bal.}Cu_{1.5}Si_4B_{14}$) of Sample 13-19 (temperature-elevating speed: 200° C./minute) and Sample 13-20 (temperature-elevating speed: 100° C./minute) in Example 12, which depended on the temperature-elevating speed during the heat treatment.

Any sample had $B_{8000}$ of 1.7 T or more. FIG. 10 shows the B-H curves of Sample 13-19 (temperature-elevating speed: 200° C./minute) and Sample 13-20 (temperature-elevating speed: 100° C./minute), both having the composition of $Fe_{bal.}Cu_{1.5}Si_4B_{14}$. It was found that even an alloy with the same composition became different in a B-H curve, exhibiting increased maximum permeability and drastically reduced hysteresis loss, when the temperature-elevating speed was elevated. This appears to be due to the fact that rapid heating uniformly forms crystal nuclei, reducing the percentage of the remaining amorphous phase. The rapid heating also expands a composition range in which $B_{8000}$ is 1.70 T or more. Accordingly, it is effective to change a heat treatment pattern depending on applications and heat treatment environment. Particularly for alloys containing a small amount of Cu or containing 5 atomic % or more of Si, this heat treatment method is effective to reduce $H_C$. This heat treatment method desirably reduces $H_C$ and increases $B_{80}$ in P-containing alloys. The same is true of alloys containing C or Ga. In any sample, 50% or more by volume of crystal grains having an average diameter of 60 nm or less were dispersed in an amorphous phase.

TABLE 12

| Sample No. | Composition (atomic %) | $T_A$ (° C.) | Speed(1) (° C./minute) | Thickness (μm) | $B_{8000}$ (T) | $B_{80}$ (T) | $H_C$ (A/m) | $\mu_m$ ($10^3$) |
|---|---|---|---|---|---|---|---|---|
| 13-1 | $Fe_{bal.}Cu_{1.3}Si_6B_{12}$ | 450 | 200 | 20.9 | 1.78 | 1.64 | 15.8 | 34 |
| 13-2 | $Fe_{bal.}Cu_{1.3}Si_6B_{12}$ | 450 | 100 | 20.9 | 1.78 | 1.61 | 22.3 | 30 |
| 13-3 | $Fe_{bal.}Cu_{1.3}Si_8B_{12}$ | 450 | 200 | 20.2 | 1.78 | 1.62 | 15.6 | 54 |
| 13-4 | $Fe_{bal.}Cu_{1.3}Si_8B_{12}$ | 450 | 100 | 20.2 | 1.78 | 1.52 | 20.7 | 45 |
| 13-5 | $Fe_{bal.}Cu_{1.3}Si_8B_{12}$ | 480 | 200 | 20.2 | 1.79 | 1.63 | 10.0 | 62 |
| 13-6 | $Fe_{bal.}Cu_{1.0}Si_2B_{14}$ | 450 | 200 | 18.0 | 1.84 | 1.70 | 23.0 | 27 |
| 13-7 | $Fe_{bal.}Cu_{1.5}Si_6B_{12}$ | 450 | 200 | 17.2 | 1.78 | 1.68 | 9.6 | 64 |
| 13-8 | $Fe_{bal.}Cu_{1.5}Si_5B_{13}$ | 450 | 200 | 17.0 | 1.78 | 1.70 | 6.4 | 65 |
| 13-9 | $Fe_{bal.}Cu_{1.6}Si_7B_{13}$ | 450 | 200 | 18.2 | 1.74 | 1.64 | 4.6 | 80 |
| 13-10 | $Fe_{bal.}Cu_{1.6}Si_7B_{13}$ | 470 | 200 | 18.2 | 1.74 | 1.56 | 6.2 | 54 |
| 13-11 | $Fe_{bal.}Cu_{1.6}Si_8B_{13}$ | 450 | 200 | 18.4 | 1.72 | 1.57 | 5.9 | 65 |
| 13-12 | $Fe_{bal.}Cu_{1.6}Si_8B_{13}$ | 470 | 200 | 18.4 | 1.72 | 1.56 | 7.0 | 40 |
| 13-13 | $Fe_{bal.}Cu_{1.6}Si_9B_{13}$ | 450 | 200 | 19.6 | 1.70 | 1.45 | 9.9 | 68 |

TABLE 12-continued

| Sample No. | Composition (atomic %) | $T_A$ (° C.) | Speed[1] (° C./minute) | Thickness (μm) | $B_{8000}$ (T) | $B_{80}$ (T) | $H_C$ (A/m) | $\mu_m$ ($10^3$) |
|---|---|---|---|---|---|---|---|---|
| 13-14 | $Fe_{bal.}Cu_{1.6}Si_9B_{13}$ | 470 | 200 | 19.6 | 1.70 | 1.44 | 8.7 | 70 |
| 13-15 | $Fe_{bal.}Cu_{1.25}Si_2B_{14}$ | 450 | 200 | 24.1 | 1.87 | 1.65 | 14.8 | 46 |
| 13-16 | $Fe_{bal.}Cu_{1.25}Si_3B_{14}$ | 450 | 200 | 19.5 | 1.77 | 1.58 | 20.0 | 33 |
| 13-17 | $Fe_{bal.}Cu_{1.35}Si_3B_{14}$ | 450 | 200 | 24.7 | 1.82 | 1.61 | 8.7 | 49 |
| 13-18 | $Fe_{bal.}Cu_{1.35}Si_3B_{14}$ | 450 | 100 | 24.7 | 1.82 | 1.60 | 9.7 | 44 |
| 13-19 | $Fe_{bal.}Cu_{1.5}Si_4B_{14}$ | 450 | 200 | 19.5 | 1.84 | 1.63 | 6.7 | 56 |
| 13-20 | $Fe_{bal.}Cu_{1.5}Si_4B_{14}$ | 450 | 100 | 19.5 | 1.81 | 1.61 | 6.8 | 51 |
| 13-21 | $Fe_{bal.}Cu_{1.5}Si_5B_{14}$ | 450 | 200 | 17.4 | 1.76 | 1.52 | 8.2 | 43 |
| 13-22 | $Fe_{bal.}Cu_{1.6}Si_6B_{14}$ | 450 | 200 | 18.4 | 1.74 | 1.59 | 6.5 | 72 |
| 13-23 | $Fe_{bal.}Cu_{1.6}Si_7B_{14}$ | 450 | 200 | 19.2 | 1.72 | 1.57 | 8.0 | 45 |
| 13-24 | $Fe_{bal.}Cu_{1.6}Si_9B_{14}$ | 450 | 200 | 22.6 | 1.70 | 1.41 | 7.7 | 43 |
| 13-25 | $Fe_{bal.}Cu_{1.5}Si_5B_{15}$ | 450 | 200 | 17.6 | 1.73 | 1.51 | 8.8 | 55 |
| 13-26 | $Fe_{bal.}Cu_{1.6}Si_6B_{15}$ | 450 | 200 | 19.5 | 1.70 | 1.53 | 8.5 | 52 |
| 13-27 | $Fe_{bal.}Cu_{1.6}Si_5B_{16}$ | 450 | 200 | 19.3 | 1.70 | 1.53 | 9.6 | 51 |
| 13-28 | $Fe_{bal.}Cu_{1.35}Si_2B_{14}P_1$ | 450 | 200 | 20.8 | 1.79 | 1.70 | 5.2 | 68 |
| 13-29 | $Fe_{bal.}Cu_{1.35}Si_2B_{12}P_2$ | 450 | 200 | 20.4 | 1.82 | 1.74 | 6.2 | 69 |
| 13-30 | $Fe_{bal.}Cu_{1.4}Si_3B_{12}P_2$ | 450 | 200 | 20.4 | 1.79 | 1.70 | 5.9 | 82 |
| 13-31 | $Fe_{bal.}Cu_{1.4}Si_3B_{13}P_2$ | 450 | 200 | 20.9 | 1.77 | 1.64 | 5.7 | 77 |
| 13-32 | $Fe_{bal}Cu_{1.5}Si_3B_{13}P_2$ | 450 | 200 | 19.9 | 1.72 | 1.41 | 10.8 | 36 |
| 13-33 | $Fe_{bal.}Cu_{1.5}Si_3B_{14}P_2$ | 450 | 200 | 19.9 | 1.71 | 1.42 | 9.8 | 53 |

Note:
[1]Temperature-elevating speed.

Figure 11:
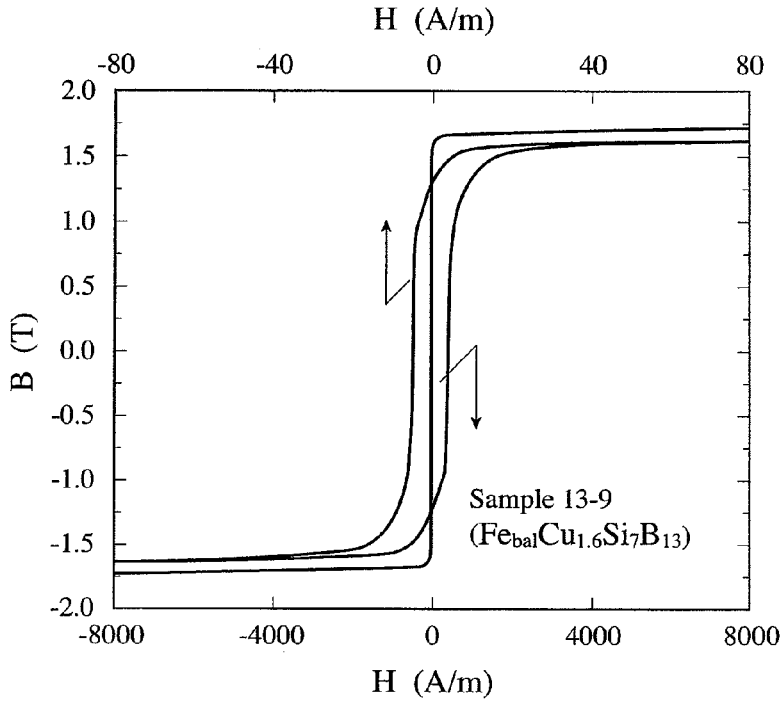
FIG. 11 is a graph showing the B-H curve of the alloy ($Fe_{bal.}Cu_{1.6}Si_7B_{13}$) of Sample 13-9 in Example 12, which was heat-treated at a high temperature for a short period of time.
Figure 12:
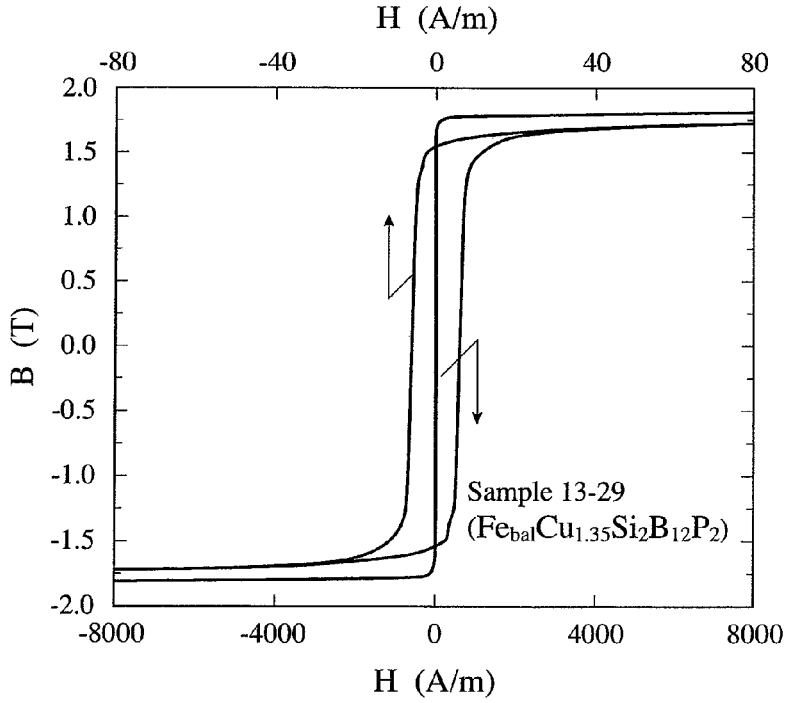
FIG. 12 is a graph showing the B-H curve of the alloy ($Fe_{bal.}Cu_{1.35}Si_2B_{12}P_2$) of Sample 13-29 in Example 12, which was heat-treated at a high temperature for a short period of time.

FIGS. 11 and 12 respectively show the B-H curves of Sample 13-9 (composition: $Fe_{bal.}Cu_{1.6}Si_7B_{13}$) and Sample 13-29 (composition: $Fe_{bal.}Cu_{1.35}Si_2B_{12}P_2$), which were measured in the maximum magnetic field of 8000 A/m and 80 A/m, respectively. Sample 13-9 had small $H_C$ and good saturation resistance. Sample 13-29 had large $B_{80}$ and good saturation resistance. These B-H curves are typical when a high-temperature heat treatment was conducted for a short period of time.

Example 13

Figure 13:
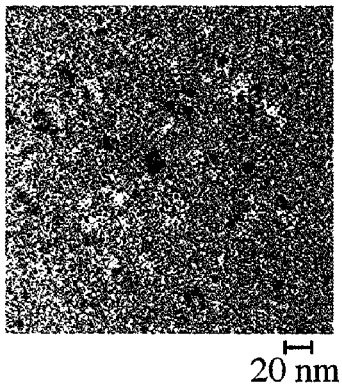
FIG. 13 is a transmission electron photomicrograph showing the microstructure of the alloy ribbon of Example 13.
Figure 14:
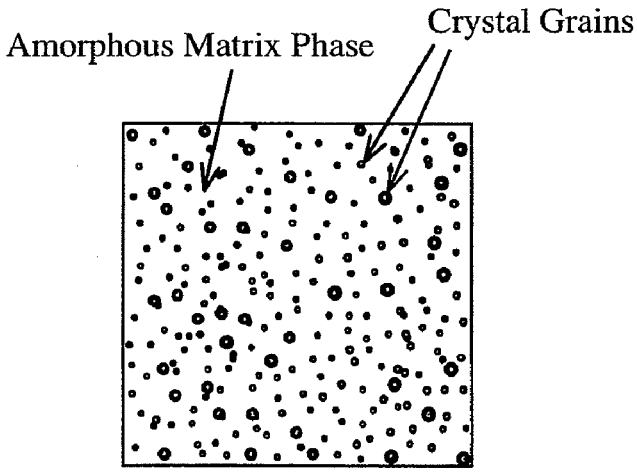
FIG. 14 is a schematic view showing the microstructure of the alloy ribbon of the present invention.

A alloy melt having a composition represented by $Fe_{bal.}Cu_{1.35}B_{14}Si_2$ (atomic %) at 1250° C. was ejected from a slit-shaped nozzle to a Cu—Be alloy roll of 300 mm in outer diameter rotating at a peripheral speed 30 m/s, to produce an alloy ribbon of 5 mm in width and 18 μm in thickness. As a result of X-ray diffraction measurement and transmission electron microscope (TEM) observation, it was found that crystal grains were dispersed in an amorphous phase in this alloy ribbon. FIG. 13 is a transmission electron photomicrograph showing the observed microstructure of the alloy ribbon, and FIG. 14 is a schematic view of the microstructure. It is clear from the microstructure that 4.8% by volume of fine crystal grains having an average diameter of about 5.5 nm were dispersed in an amorphous phase.

Figure 15:
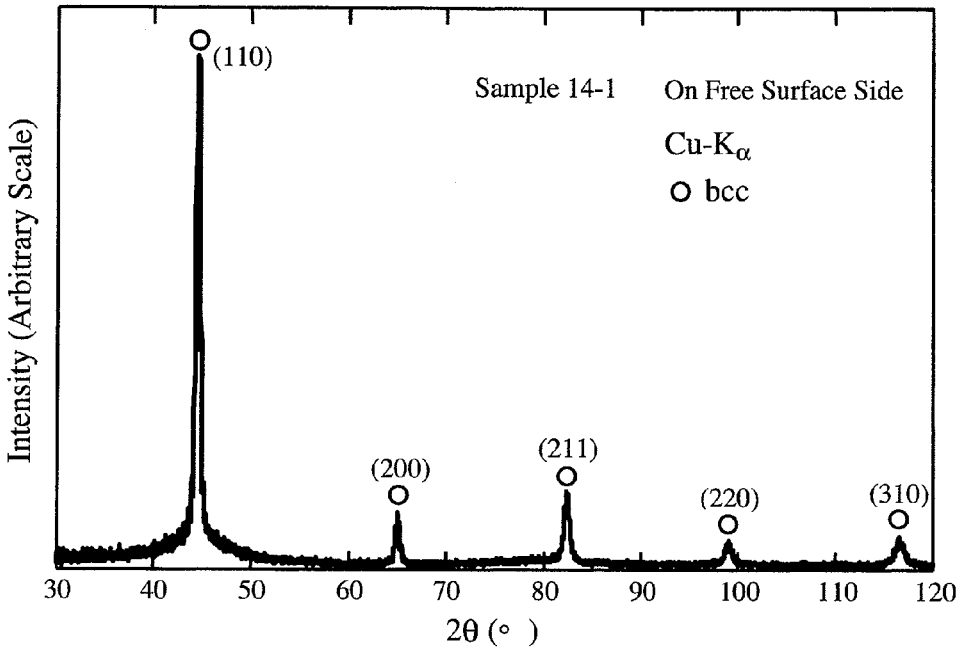
FIG. 15 is a graph showing the X-ray diffraction pattern of the magnetic alloy of Example 13.
Figure 16:
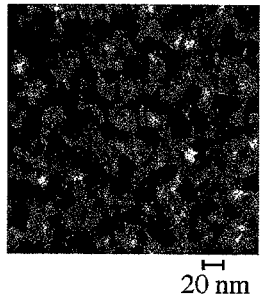
FIG. 16 is a transmission electron photomicrograph showing the microstructure of the magnetic alloy of Example 13.
Figure 17:
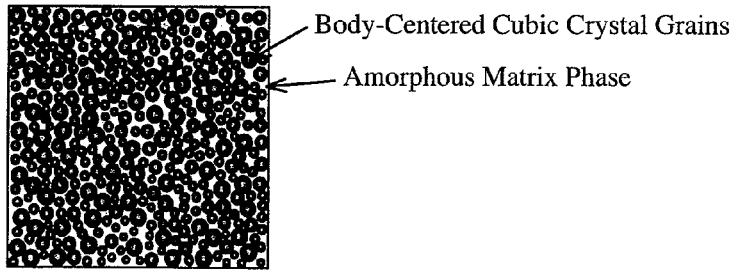
FIG. 17 is a schematic view showing the microstructure of the magnetic alloy of the present invention.

A wound core of 19 mm in outer diameter and 15 mm in inner diameter formed by the alloy ribbon was placed in a furnace having a nitrogen gas atmosphere, and heated from room temperature to 420° C. at 7.5° C./minute while applying a magnetic field of 240K A/m in a height direction of the wound core. After being kept at 420° C. for 60 minutes, it was cooled to 200° C. at an average speed of 1.2° C./minute, taken out of the furnace, and cooled to room temperature to obtain Sample 14-1. Sample 14-1 was measured with respect to magnetic properties and X-ray diffraction, and observed by a transmission electron microscope (TEM). With respect to Sample 14-1 after the heat treatment, FIG. 15 shows the X-ray diffraction pattern, FIG. 16 shows the microstructure of the alloy ribbon observed by a transmission electron microscope, and FIG. 17 is a schematic view of the microstructure. It is clear from the microstructure and the X-ray diffraction pattern that 60% by volume of fine crystal grains having a body-centered-cubic (bcc) structure and an average diameter of about 14 nm were dispersed in an amorphous phase. EDX analysis revealed that the crystal grains had a Fe-based composition.

Table 13 shows the saturation magnetic flux density Bs, coercivity Hc, AC specific initial permeability $\mu_{1k}$ at 1 kHz, core loss Pcm at 20 kHz and 0.2 T, and average crystal diameter D of samples obtained by heat-treating Sample 14-1. For comparison, the magnetic properties and crystal grain diameters of an alloy (Sample 14-2) crystallized by heat-treating a completely amorphous alloy having a composition represented by $Fe_{bal.}B_{14}Si_2$ (atomic %), known nano-crystalline soft magnetic alloys (Samples 14-3 and 14-4) obtained by heat-treating amorphous alloys having a composition represented by $Fe_{bal.}Cu_1Nb_3S_{13.5}B_9$ and $Fe_{bal.}Nb_7B_9$ (atomic %), a typical Fe-based, amorphous alloy (Sample 14-5) having a composition represented by $Fe_{bal.}B_{13}Si_9$ alloy (atomic %), and a silicon steel ribbon (Sample 14-6) containing 6.5% by mass of Si and having a thickness of 50 μm are also shown in Table 13.

The saturation magnetic flux density Bs of the magnetic alloy (Sample 14-1) of the present invention was 1.85 T, higher than those of the conventional Fe-based, nano-crystalline alloys (Samples 14-3 and 14-4) and the conventional Fe-based, amorphous alloy (Sample 14-5). The alloy (Sample 14-2) crystallized by heat-treating a completely amorphous alloy had extremely poor soft magnetic properties, with extremely large core loss Pcm. Because Sample 14-1 of the present invention has higher AC specific initial permeability $\mu_{1k}$ at 1 kHz and lower core loss Pcm than those of the conventional silicon steel ribbon (Sample 14-6), it is suitable for power choke coils, high-frequency transformers, etc.

TABLE 13

| Sample No. | Composition (atomic %) | Bs (T) | Hc (A/m) | $\mu_{1k}$ | Pcm (W/kg) | D (nm) |
|---|---|---|---|---|---|---|
| 14-1 | $Fe_{bal.}Cu_{1.35}B_{14}Si_2$ | 1.85 | 6.5 | 7000 | 4.1 | 14 |
| 14-2* | $Fe_{bal.}B_{14}Si_2$ | 1.80 | 800 | 20 | — | 60 |

TABLE 13-continued

| Sample No. | Composition (atomic %) | Bs (T) | Hc (A/m) | $\mu_{1k}$ | Pcm (W/kg) | D (nm) |
|---|---|---|---|---|---|---|
| 14-3* | $Fe_{bal.}Cu_1Nb_3Si_{13.5}B_9$ (Nano-Crystalline Alloy) | 1.24 | 0.5 | 120000 | 2.1 | 12 |
| 14-4* | $Fe_{bal.}Nb_7B_9$ (Nano-Crystalline Alloy) | 1.52 | 5.8 | 6100 | 8.1 | 9 |
| 14-5* | $Fe_{bal.}B_{13}Si_9$ (Amorphous Alloy) | 1.56 | 4.2 | 5000 | 8.8 | — |
| 14-6* | Silicon Steel Ribbon(1) | 1.80 | 28 | 800 | 58 | — |

Note:
*Comparative Example.
(1)Silicon steel ribbon containing 6.5% by mass of Si.

Sample 14-1 had a saturation magnetostriction constant λs of $+10\times10^{-6}$ to $+5\times10^{-6}$, less than ½ of the λs of $+27\times10^{-6}$ of the Fe-based, amorphous alloy (Sample 14-4). Accordingly, even if impregnation, bonding, etc. are conducted to Sample 14-1, it is less deteriorated in soft magnetic properties than the Fe-based, amorphous alloy, suitable for cut cores for power choke coils and motor cores.

Evaluation revealed that power chokes formed by the magnetic alloy of the present invention had better DC superimposing characteristics than those of dust cores and Fe-based, amorphous alloy choke coils, thereby providing higher-performance choke coils.

Figure 18:
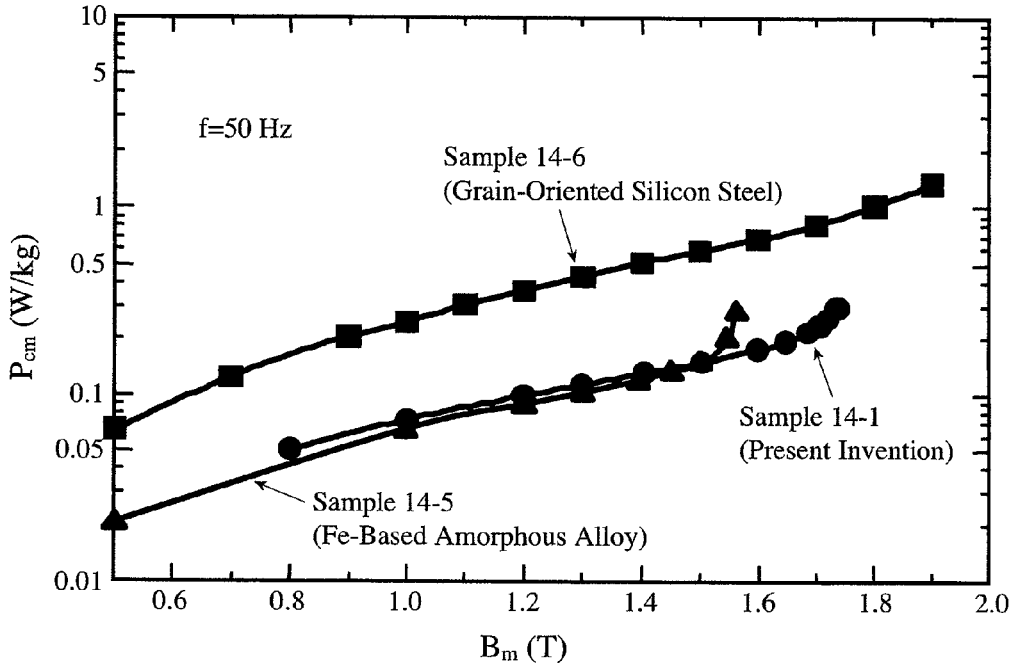
FIG. 18 is a graph showing the dependency of the core loss Pcm at 50 Hz of a wound core formed by the magnetic alloy of Example 14 and a wound core formed by a conventional grain-oriented silicon steel plate on a magnetic flux density $B_m$.

A wound core formed by the magnetic alloy of Sample 14-1 was measured with respect to core loss Pcm per a unit weight at 50 Hz. The dependency of the core loss Pcm on a magnetic flux density $B_m$ is shown in FIG. 18. For comparison, with respect to cores formed by the conventional grain-oriented electromagnetic steel plate (Sample 14-6) and the Fe-based, amorphous alloy (Sample 14-5), the dependency of core loss Pcm on a magnetic flux density $B_m$ is also shown in FIG. 18. The core loss of the wound core of Sample 14-1 was on the same level as that of the Fe-based, amorphous alloy (Sample 14-5), lower than that of Sample 14-5 particularly at 1.5 T or more, and did not rapidly increase until about 1.65 T. Accordingly, the wound core of Sample 14-1 can provide transformers, etc. operable at a higher magnetic flux density than the conventional Fe-based, amorphous alloy, contributing to the miniaturization of transformers, etc. Also, the wound core of Sample 14-1 exhibits lower core loss even in a high magnetic flux density region than that of the grain-oriented electromagnetic steel plate (Sample 14-6), it is operable with extremely small energy consumption.

Figure 19:
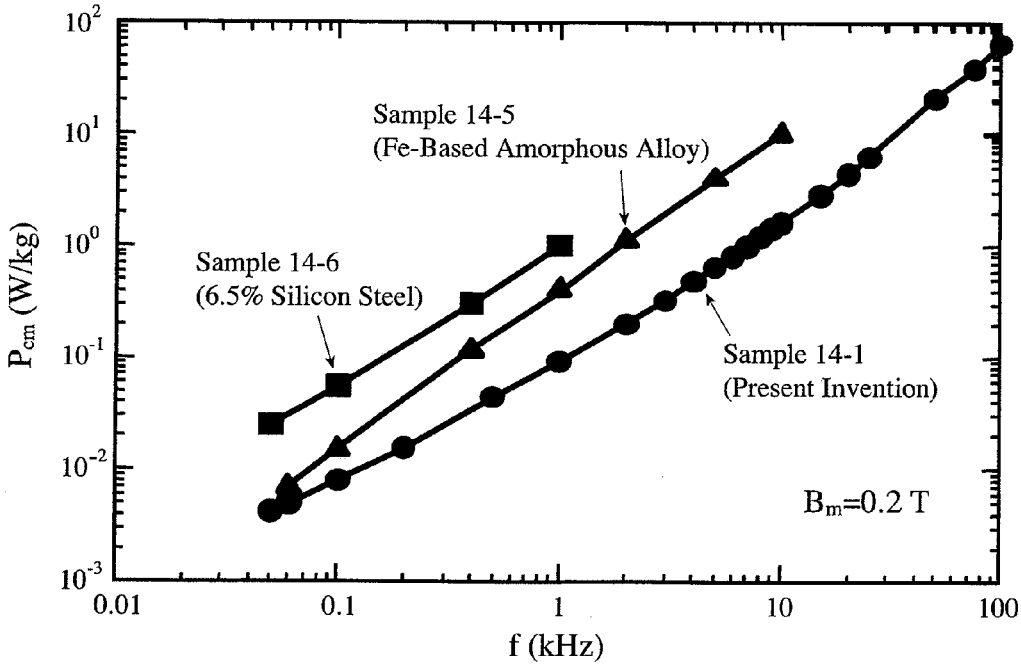
FIG. 19 is a graph showing the dependency of the core loss Pcm at 0.2 T of a wound core formed by the magnetic alloy of Example 15 and wound cores formed by various conventional soft magnetic materials on a frequency.

With respect to wound cores formed by the magnetic alloy of Sample 14-1, the Fe-based, amorphous alloy (Sample 14-5) and the silicon steel ribbon containing 6.5% by mass of Si (Sample 14-6), the dependency of core loss Pcm per a unit weight at 0.2 T on a frequency is shown in FIG. 19. Having a higher saturation magnetic flux density with lower core loss than those of the Fe-based, amorphous alloy (Sample 14-5), the magnetic alloy of Sample 14-1 is suitable for cores of high-frequency reactor choke coils, transformers, etc.

The AC specific initial permeability of the magnetic alloy of Sample 14-1 was 6000 or more in a magnetic field up to 100 kHz, higher than that of Samples 14-5 and 14-6. Accordingly, the magnetic alloy of Sample 14-1 is suitable for choke coils such as common mode choke coils, transformers such as pulse transformers, magnetic shields, antenna cores, etc.

Example 14

Each Alloy melt having the composition shown in Table 14 at 1300° C. was ejected onto a Cu—Be alloy roll of 300 mm in outer diameter rotating at a peripheral speed of 32 m/s to produce an alloy ribbon of 5 mm in width and about 21 μm in thickness. The X-ray diffraction measurement and TEM observation revealed that 30% by volume or less of crystal grains were dispersed in an amorphous phase in each alloy ribbon.

A wound core of 19 mm in outer diameter and 15 mm in inner diameter formed by each alloy ribbon was heated from room temperature to 410° C. at 8.5° C./minute in a furnace having a nitrogen gas atmosphere, kept at 410° C. for 60 minutes, and then air-cooled to room temperature. The average cooling speed was 30° C./minute or more. The resultant magnetic alloys (Samples 15-1 to 15-33) were measured with respect to magnetic properties and X-ray diffraction, and observed by a transmission electron microscope. The microstructure observation of any sample by a transmission electron microscope revealed that it was occupied by 30% or more by volume of fine crystal grains of a body-centered-cubic structure having an average diameter of 60 nm or less.

Table 14 shows the saturation magnetic flux density Bs, coercivity Hc, and core loss Pcm at 20 kHz and 0.2 T of heat-treated Samples 15-1 to 15-33. Also shown in Table 14 for comparison are the magnetic properties of Sample 15-34 ($Fe_{bal.}B_6$) which was not heat-treated and occupied by 100% of crystal grains having diameters of 100 nm or more, and conventional typical nano-crystalline soft magnetic alloys (Samples 15-35 and 15-36) which were completely amorphous before heat treatment. It was found that the magnetic alloys of the present invention (Samples 15-1 to 15-33) had high saturation magnetic flux density Bs, and low coercivity Hc and core loss Pcm. On the other hand, Sample 15-34 had too large Hc, so that its Pcm could not be measured. Samples 15-35 and 15-36 had Bs of 1.24 T and 1.52 T, respectively, lower than those of Samples 15-1 to 15-33 of the present invention.

TABLE 14

| Sample No. | Composition (atomic %) | Bs (T) | Hc (A/m) | Pcm (W/kg) |
|---|---|---|---|---|
| 15-1 | $Fe_{bal.}Cu_{1.25}B_{15}Si_1$ | 1.81 | 56.4 | 7.8 |
| 15-2 | $Fe_{bal.}Cu_{1.35}B_{15}$ | 1.79 | 28.9 | 6.9 |
| 15-3 | $Fe_{bal.}Cu_{1.2}B_{16}$ | 1.73 | 23.5 | 6.6 |
| 15-4 | $Fe_{bal.}Cu_{1.5}B_{12}$ | 1.81 | 15.8 | 6.5 |
| 15-5 | $Fe_{bal.}Cu_{1.0}Au_{0.25}B_{15}Si_1$ | 1.84 | 10.2 | 6.4 |
| 15-6 | $Fe_{bal.}Cu_{1.25}B_{15}Si_1$ | 1.84 | 8.8 | 6.3 |
| 15-7 | $Fe_{bal.}Cu_{1.25}B_{15}Si_1$ | 1.79 | 6.8 | 4.8 |
| 15-8 | $Fe_{bal.}Cu_{1.25}B_{15}Si_1$ | 1.85 | 6.5 | 4.1 |
| 15-9 | $Fe_{bal.}Ni_2Cu_{1.25}B_{14}Si_2$ | 1.81 | 6.5 | 4.2 |
| 15-10 | $Fe_{bal.}Co_2Cu_{1.25}B_{14}Si_2$ | 1.82 | 6.8 | 4.7 |
| 15-11 | $Fe_{bal.}Cu_{1.35}B_{14}Si_3Al_{0.5}$ | 1.80 | 8.5 | 6.1 |
| 15-12 | $Fe_{bal.}Cu_{1.35}B_{14}Si_3P_{0.5}$ | 1.79 | 8.0 | 5.8 |
| 15-13 | $Fe_{bal.}Cu_{1.35}B_{14}Si_3Ge_{0.5}$ | 1.80 | 7.9 | 5.3 |
| 15-14 | $Fe_{bal.}Cu_{1.35}B_{14}Si_3C_{0.5}$ | 1.80 | 8.5 | 6.2 |
| 15-15 | $Fe_{bal.}Cu_{1.35}B_{14}Si_3Au_{0.5}$ | 1.81 | 7.0 | 4.4 |
| 15-16 | $Fe_{bal.}Cu_{1.35}B_{14}Si_3Pt_{0.5}$ | 1.81 | 7.1 | 4.5 |
| 15-17 | $Fe_{bal.}Cu_{1.35}B_{14}Si_3W_{0.5}$ | 1.79 | 7.2 | 4.7 |
| 15-18 | $Fe_{bal.}Cu_{1.35}B_{14}Si_3Sn_{0.5}$ | 1.80 | 7.2 | 4.8 |
| 15-19 | $Fe_{bal.}Cu_{1.35}B_{14}Si_3In_{0.5}$ | 1.80 | 7.3 | 4.5 |
| 15-20 | $Fe_{bal.}Cu_{1.35}B_{14}Si_3Ga_{0.5}$ | 1.81 | 7.1 | 4.4 |
| 15-21 | $Fe_{bal.}Cu_{1.35}B_{14}Si_3Ni_{0.5}$ | 1.81 | 7.0 | 4.3 |
| 15-22 | $Fe_{bal.}Cu_{1.35}B_{14}Si_3Hf_{0.5}$ | 1.78 | 7.2 | 4.6 |
| 15-23 | $Fe_{bal.}Cu_{1.35}B_{14}Si_3Nb_{0.5}$ | 1.78 | 6.9 | 4.3 |
| 15-24 | $Fe_{bal.}Cu_{1.35}B_{14}Si_3Zr_{0.5}$ | 1.78 | 7.0 | 4.7 |
| 15-25 | $Fe_{bal.}Cu_{1.35}B_{14}Si_3Ta_{0.5}$ | 1.78 | 7.0 | 4.5 |
| 15-26 | $Fe_{bal.}Cu_{1.35}B_{14}Si_3Mo_{0.5}$ | 1.78 | 7.1 | 4.8 |
| 15-27 | $Fe_{bal.}Cu_{1.25}B_{13}Si_4$ | 1.74 | 6.5 | 4.2 |

TABLE 14-continued

| Sample No. | Composition (atomic %) | Bs (T) | Hc (A/m) | Pcm (W/kg) |
|---|---|---|---|---|
| 15-28 | $Fe_{bal.}Cu_{1.5}B_{15}Si_3$ | 1.81 | 55.2 | 7.6 |
| 15-29 | $Fe_{bal.}Cu_{1.35}B_{12}Si_5$ | 1.79 | 27.5 | 6.8 |
| 15-30 | $Fe_{bal.}Cu_{1.35}B_{16}Si_3Ge_{0.5}$ | 1.80 | 8.2 | 6.0 |
| 15-31 | $Fe_{bal.}Cu_{1.4}Nb_{0.025}B_{14}Si_1$ | 1.85 | 8.8 | 6.4 |
| 15-32 | $Fe_{bal.}Cu_{1.55}V_{0.2}Si_{14.5}B_8$ | 1.77 | 7.8 | 5.2 |
| 15-33 | $Fe_{bal.}Cu_{1.8}Si_4B_{13}Zr_{0.2}$ | 1.81 | 6.5 | 4.3 |
| 15-34* | $Fe_{bal.}B_6$ | 1.95 | 4000 | —(1) |
| 15-35* | $Fe_{bal.}Cu_{1.0}Nb_3Si_{13.5}B_9$ | 1.24 | 0.5 | 2.1 |
| 15-36* | $Fe_{bal.}Nb_7B_9$ | 1.52 | 5.8 | 8.1 |

Note:
*Comparative Example.
(1)Could not be measured.

Example 15

An alloy melt having a composition represented by $Fe_{bal.}Cu_{1.35}Si_2B_{14}$ (atomic %) at 1250° C. was ejected from a slit-shaped nozzle onto a Cu—Be alloy roll of 300 mm in outer diameter rotating at a peripheral speed of 30 m/s, to produce an alloy ribbon of 5 mm in width and 18 μm in thickness. The X-ray diffraction measurement and transmission electron microscope (TEM) observation revealed that crystal grains were dispersed in an amorphous phase in this alloy ribbon. The microstructure observation by an electron microscope revealed that fine crystal grains having an average diameter of about 5.5 nm were dispersed with an average distance of 24 nm in an amorphous phase.

Figure 20:
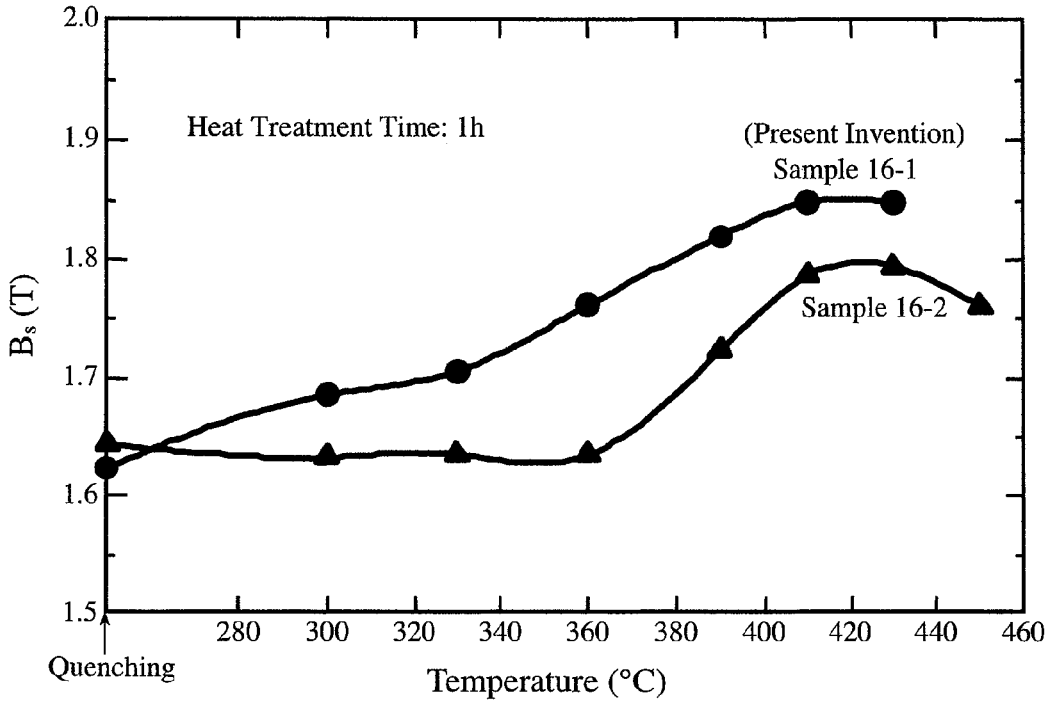
FIG. 20 is a graph showing the dependency of the saturation magnetic flux density Bs of the magnetic alloy of Example 17 (present invention) and the magnetic alloy of Comparative Example on a heat treatment temperature.
Figure 21:
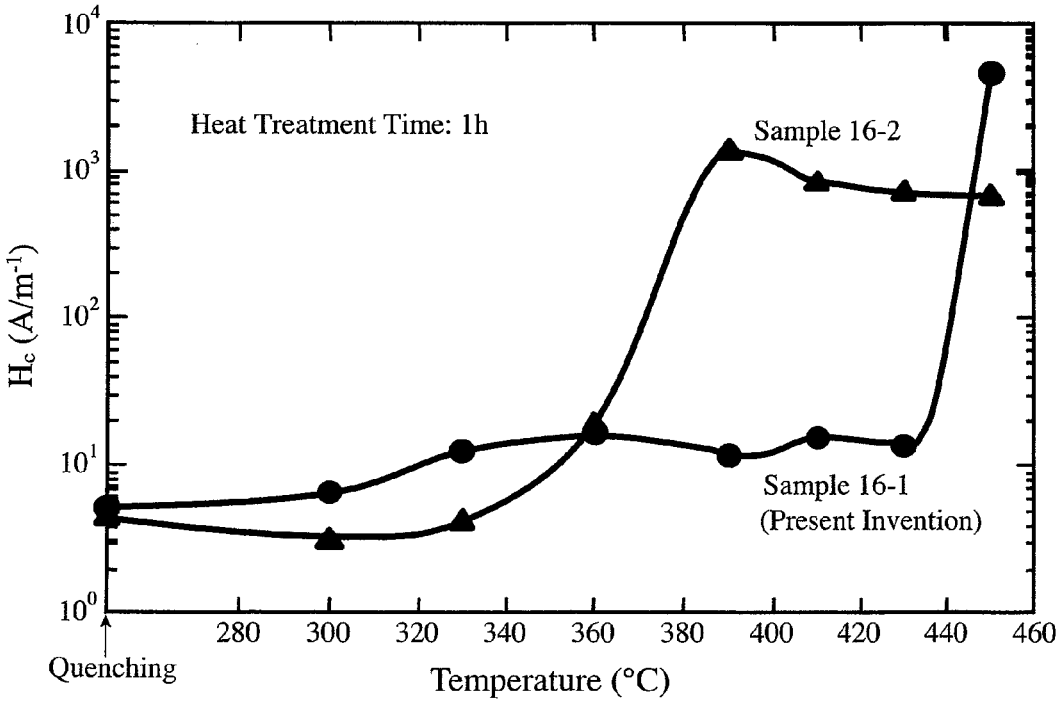
FIG. 21 is a graph showing the dependency of the coercivity Hc of the magnetic alloys of Example 17 (present invention) and Comparative Example on a heat treatment temperature.

The alloy ribbon was cut to 120 mm, held in a tubular furnace having a nitrogen gas atmosphere heated to the temperature shown in FIGS. 20 and 21 for 60 minutes, taken out of the furnace, and air-cooled to at an average speed of 30° C./minute or more. The dependency of magnetic properties of Sample 16-1 thus obtained on a heat treatment temperature was examined. The X-ray diffraction measurement and TEM observation of Sample 16-1 revealed that 30% or more by volume of fine crystal grains of a body-centered-cubic structure having an average diameter of 50 nm or less were dispersed in an amorphous phase in a magnetic alloy heat-treated at 330° C. or higher. EDX analysis revealed that the crystal grains were based on Fe.

For comparison, an alloy melt having a composition represented by $Fe_{bal.}Si_2B_{14}$ (atomic %) at 1250° C. was ejected from a slit-shaped nozzle onto a Cu—Be alloy roll of 300 mm in outer diameter rotating at a peripheral speed of 33 m/s, to produce an alloy ribbon of 5 mm in width and 18 μm in thickness. The X-ray diffraction measurement and TEM observation revealed that this alloy ribbon was amorphous. This alloy ribbon was cut to 120 mm, similarly heat-treated, and the dependency of magnetic properties of Sample 16-2 thus obtained on a heat treatment temperature was examined.

FIG. 20 shows the dependency of the saturation magnetic flux density Bs on a heat treatment temperature, and FIG. 21 shows the dependency of the coercivity Hc on a heat treatment temperature. In the method of the present invention (Sample 16-1), the heat treatment temperature of 330° C. or higher increased Bs without increasing Hc, providing an excellent soft magnetic alloy with high Bs. The highest magnetic properties could be obtained particularly at a heat treatment temperature near 420° C. On the other hand, when an amorphous alloy was heat-treated (Sample 16-2), the Hc increased rapidly by crystallization.

It is thus clear that the heat treatment of an alloy having a structure in which 30% by volume or less of crystal grains having an average diameter of 30 nm or less were dispersed with an average distance of 50 nm or less in an amorphous phase provided a magnetic alloy having a structure in which 30% or more by volume of body-centered-cubic crystal grains having an average diameter of 60 nm or less were dispersed in an amorphous phase, which had excellent soft magnetic properties including high Bs.

Example 16

An alloy melt having a composition represented by $Fe_{bal.}Cu_{1.25}Si_2B_{14}$ (atomic %) at 1250° C. was ejected from a slit-shaped nozzle onto a Cu—Be alloy roll of 300 mm in outer diameter rotating at various speeds, to produce alloy ribbons of 5 mm in width, which contained different volume fractions of crystal grains in an amorphous phase. The volume fraction of crystal grains was determined from a transmission electron photomicrograph. The volume fraction of crystal grains changed with the rotation speed of the roll. A wound core of 19 mm in outer diameter and 15 mm in inner diameter formed by each alloy ribbon was heat-treated at 410° C. for 1 hour, to obtain the magnetic alloys of Samples 17-1 to 17-8. The saturation magnetic flux density Bs and coercivity Hc of these alloys were measured. The heat-treated magnetic alloys had the volume fractions of crystal grains of 30% or more, and Bs of 1.8 T to 1.87 T.

Table 15 shows the coercivity Hc of Samples 17-1 to 17-8. The magnetic alloy (Sample 17-1) obtained by heat-treating an alloy without crystal grains had as extremely large coercivity Hc as 750 A/m. The magnetic alloys of the present invention (Samples 17-2 to 17-5) obtained by heat-treating alloys in which the volume fractions of crystal grains were more than 0% and 30% or less had small Hc and high Bs, indicating that they had excellent soft magnetic properties. On the other hand, the alloy (Samples 17-6 to 17-8) obtained by heat-treating alloys in which the volume fractions of crystal grains were more than 30% contained coarse crystal grains, having increased Hc.

It is thus clear that high-Bs magnetic alloys obtained by heat-treating Fe-rich alloys in which fine crystal grains are dispersed at proportions of more than 0% and 30% or less are superior to those obtained by heat-treating completely amorphous alloys or alloys containing more than 30% of crystal grains, in soft magnetic properties.

TABLE 15

| Sample No. | Volume Fraction (%) of Crystal Grains in Amorphous Phase Before Heat Treatment | Hc (A/m) After Heat Treatment |
|---|---|---|
| 17-1 | 0 | 750 |
| 17-2 | 3 | 6.4 |
| 17-3 | 4.5 | 6.0 |
| 17-4 | 10 | 6.3 |
| 17-5 | 27 | 7.2 |
| 17-6 | 34 | 70 |
| 17-7 | 53 | 120 |
| 17-8 | 60 | 250.3 |

Example 17

An alloy melt having a composition represented by $Fe_{bal.}Cu_{1.35}B_{14}Si_2$ (atomic %) at 1250° C. was ejected from a slit-shaped nozzle onto a Cu—Be alloy roll of 300 mm in outer diameter rotating at a peripheral speed of 30 m/s, to produce an alloy ribbon of 5 mm in width and 18 μm in thickness. When this alloy ribbon was bent to 180°, it was broken, indicating that it was brittle. The X-ray diffraction measurement and TEM observation revealed that the alloy ribbon had a structure in which crystal grains were distributed in an amorphous phase. The microstructure observed by an electron microscope indicated that 4.8% by volume of fine crystal grains having an average diameter of about 5.5 nm were dispersed in an amorphous phase. Composition analysis revealed that the crystal grains were based on Fe.

The alloy ribbon was cut to 120 mm, and heat-treated in a furnace having a nitrogen gas atmosphere at 410° C. for 1 hour to measure its magnetic properties. The microstructure observation and X-ray diffraction measurement revealed that 60% of the alloy structure was occupied by fine, body-centered-cubic crystal grains having an average diameter of about 14 nm, the remainder being an amorphous phase.

After the heat treatment, the magnetic alloy had saturation magnetic flux density Bs of 1.85 T, coercivity Hc of 6.5 A/m, AC specific initial permeability $\mu_{1k}$ of 7000 at 1 kHz, core loss Pcm of 4.1 W/kg at 20 kHz and 0.2 T, an average crystal diameter D of 14 nm, and a saturation magnetostriction constant $\lambda s$ of $+14\times10^{-6}$.

The alloy ribbon (not heat-treated) was pulverized by a vibration mill, and classified by a sieve of 170 mesh. The X-ray diffraction measurement and microstructure observation revealed that the resultant powder had similar X-ray diffraction pattern and microstructure to those of the ribbon. Part of this powder was heat-treated under the conditions of an average temperature-elevating speed of 20° C./minute, a holding temperature of 410° C., keeping time of 1 hour and an average cooling speed of 7° C./minute. The resultant magnetic alloy had coercivity of 29 A/m and saturation magnetic flux density of 1.84 T. The X-ray diffraction and microstructure observation revealed that the heat-treated powder had similar X-ray diffraction pattern and microstructure to those of the heat-treated ribbon.

Example 18

100 parts by mass of a mixed powder of the alloy powder (not heat-treated) produced in Example 18 and $SiO_2$ particles having an average diameter of 0.5 μm at a volume ratio of 95: was mixed with 6.6 parts by mass of an aqueous polyvinyl alcohol solution (3% by mass), completely dried while stirring at 100° C. for 1 hour, and classified by a sieve of 115 mesh. The resultant composite particles were charged into a molding die coated with a boron nitride lubricant, and pressed at 500 MPa to form a ring-shaped dust core (Sample 19-1) of 12 mm in inner diameter, 21.5 mm in outer diameter and 6.5 mm in height. This dust core was heat-treated at 410° C. for 1 hour in a nitrogen atmosphere. The TEM observation revealed that the alloy particles in the dust core had a structure in which nano-crystalline grains were dispersed in an amorphous matrix, like the heat-treated alloy of Example 1. This dust core had specific initial permeability of 78.

Figure 22:
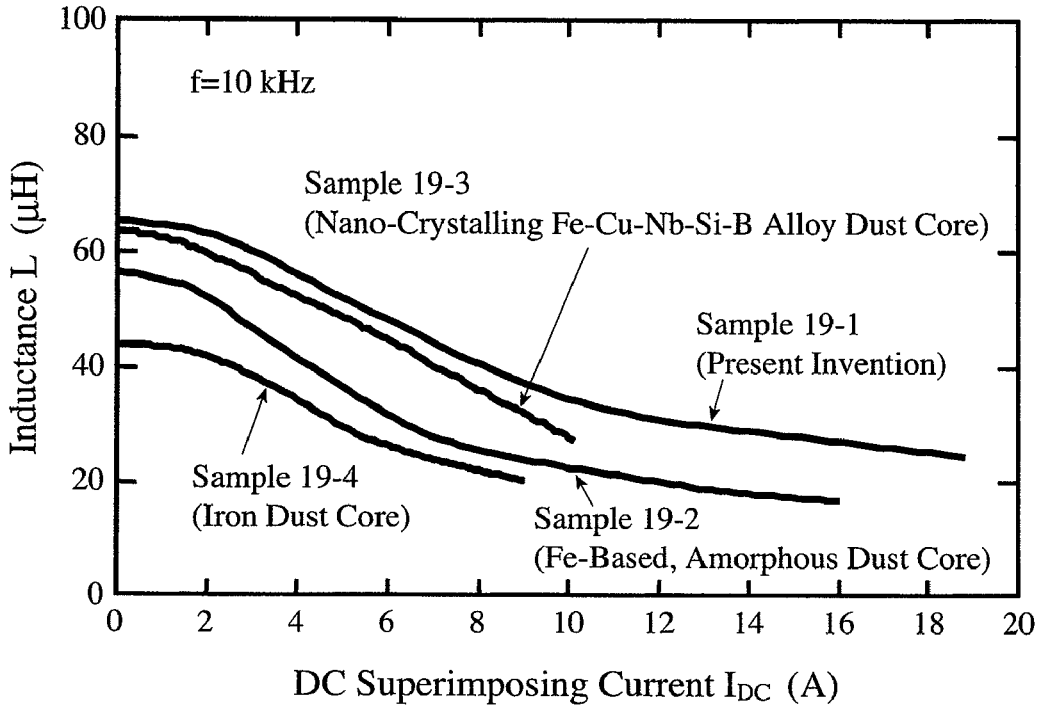
FIG. 22 is a graph showing the DC superimposing characteristics of choke coils formed by the magnetic alloys of Example 20 (present invention) and Comparative Example.

Ring-shaped dust cores having the same shape as in Sample 19-1 were produced from the Fe-based amorphous powder (Sample 19-2), the conventional Fe-based, nano-crystalline alloy powder (Sample 19-3) having a composition represented by $Fe_{bal.}Cu_1Nb_3Si_{13.5}B_9$ (atomic %), and iron powder (Sample 19-4). A 30-turn coil was provided on each ring-shaped dust core to produce a choke coil, whose DC superimposing characteristics were measured. The results are shown in FIG. 22. As is clear from FIG. 22, the choke coil of the present invention had larger inductance L than those of choke coils using the Fe-based amorphous dust core (Sample 19-2), the Fe—Cu—Nb—Si—B nano-crystalline alloy dust core (Sample 19-3) and the iron powder (Sample 19-4) up to a high DC-superimposed current, indicating that the choke coil of the present invention had excellent DC superimposing characteristics. Accordingly, the choke coil of the present invention is operable with large current, and can be miniaturized.

EFFECT OF THE INVENTION

The magnetic alloy of the present invention having a high saturation magnetic flux density and low core loss can produce high-performance magnetic parts with stable magnetic properties. It is suitable for applications used with high-frequency current (particularly pulse current), particularly for power electronic parts whose priority is to avoid magnetic saturation. Because a heat treatment is conducted to alloys having fine crystal grains dispersed in an amorphous phase in the method of the present invention, the growth of crystal grains is suppressed, thereby producing magnetic alloys with small coercivity, a high magnetic flux density in a weak magnetic field, and small hysteresis loss.

What is claimed is:

1. A magnetic alloy having a composition represented by the following general formula (1):

$$Fe_{100-x-y}Cu_xB_y(\text{atomic }\%) \quad (1),$$

wherein x and y are numbers meeting the conditions of $1.2\leqq x\leqq 1.6$, and $10\leqq y\leqq 20$, wherein said magnetic alloy has a structure containing crystal grains having an average diameter of 60 nm or less which is dispersed in a proportion of 30% or more by volume in an amorphous matrix, and a saturation magnetic flux density of 1.7 T or more and a coercivity of 24 A/m or less, and wherein said magnetic alloy is obtained by heat-treating a fine crystalline alloy having a structure in which crystal grains having an average diameter of 30 nm or less are dispersed in an amorphous phase in a proportion of more than 0% by volume and 30% by volume or less.

2. The magnetic alloy according to claim 1, which has maximum permeability of 20,000 or more.

3. The magnetic alloy according to claim 1, wherein a part of Fe is substituted by Ni and/or Co in a proportion of 10 atomic % or less based on Fe.

4. The magnetic alloy according to claim 1, wherein a part of Fe is substituted by at least one element selected from the group consisting of Ti, Zr, Hf, V, Nb, Ta, Cr, Mo, W, Mn, Re, platinum-group elements, Au, Ag, Zn, In, Sn, As, Sb, Bi, Y, N, 0 and rare earth elements in a proportion of 5 atomic % or less based on Fe.

5. The magnetic alloy according to claim 1, which is in a powder or flake shape.

6. A magnetic alloy having a composition represented by the following general formula (2):

$$Fe_{100-x-y-z}Cu_xB_yX_z(\text{atomic }\%) \quad (2),$$

wherein X is at least one element selected from the group consisting of Si, S, C, P, Al, Ge, Ga and Be, and x, y and z are numbers meeting the conditions of $1.2\leqq x\leqq 1.6$, $12\leqq y\leqq 17$, $0<z\leqq 7$, and $13<y+z\leqq 20$, wherein said magnetic alloy has a structure containing crystal grains having an average diameter of 60 nm or less which is dispersed in a proportion of 30% or more by volume in an amorphous matrix, and a saturation magnetic flux density of 1.7 T or more and a coercivity of 24 A/m or less, and wherein said magnetic alloy is obtained by heat-treating a fine crystalline alloy having a structure in which crystal grains having an average diameter of 30 nm or less are dispersed in an amorphous phase in a proportion of more than 0% by volume and 30% by volume or less.

7. The magnetic alloy according to claim 6, wherein said X is Si and/or P.

8. The magnetic alloy according to claim 6, which has maximum permeability of 20,000 or more.

9. The magnetic alloy according to claim 6, wherein a part of Fe is substituted by Ni and/or Co in a proportion of 10 atomic % or less based on Fe.

10. The magnetic alloy according to claim 6, wherein a part of Fe is substituted by at least one element selected from the group consisting of Ti, Zr, Hf, V, Nb, Ta, Cr, Mo, W, Mn, Re, platinum-group elements, Au, Ag, Zn, In, Sn, As, Sb, Bi, Y, N, 0 and rare earth elements in a proportion of 5 atomic % or less based on Fe.

11. The magnetic alloy according to claim 6, which is in a powder or flake shape.

12. A magnetic part made of the magnetic alloy according to claim 1.

13. A magnetic part made of the magnetic alloy according to claim 6.

14. The magnetic alloy according to claim 1, wherein a part of Fe is substituted by Ni and/or Co in a proportion of 10 atomic % or less based on Fe, and at least one element selected from the group consisting of Ti, Zr, Hf, V, Nb, Ta, Cr, Mo, W, Mn, Re, platinum-group elements, Au, Ag, Zn, In, Sn, As, Sb, Bi, Y, N, O and rare earth elements in a proportion of 5 atomic % or less based on Fe.

15. The magnetic alloy according to claim 1, wherein $1.2 \leqq x \leqq 1.6$ and $12 \leqq y \leqq 17$.

16. The magnetic alloy according to claim 1, wherein $1.2 \leqq x \leqq 1.6$ and $12 \leqq y \leqq 15$.

17. The magnetic alloy according to claim 1, wherein an average diameter of the crystal grains in the fine crystalline alloy is 0.5 nm to 20 nm.

18. The magnetic alloy according to claim 1, wherein an average distance between the crystal grains in the fine crystalline alloy is 50 nm or less.

19. The magnetic alloy according to claim 6, wherein a part of Fe is substituted by Ni and/or Co in a proportion of 10 atomic % or less based on Fe, and at least one element selected from the group consisting of Ti, Zr, Hf, V, Nb, Ta, Cr, Mo, W, Mn, Re, platinum-group elements, Au, Ag, Zn, In, Sn, As, Sb, Bi, Y, N, O and rare earth elements in a proportion of 5 atomic % or less based on Fe.

20. The magnetic alloy according to claim 6, wherein $1.2 \leqq x \leqq 1.6$, $12 \leqq y \leqq 15$, $0 < z \leqq 5$, and $14 \leqq y+z \leqq 19$.

21. The magnetic alloy according to claim 6, wherein $1.2 \leqq x \leqq 1.6$, $12 \leqq y \leqq 15$, $0 < z \leqq 4$, and $14 \leqq y+z \leqq 17$.

22. The magnetic alloy according to claim 6, wherein an average diameter of the crystal grains in the fine crystalline alloy is 0.5 nm to 20 nm.

23. The magnetic alloy according to claim 6, wherein an average distance between the crystal grains in the fine crystalline alloy is 50 nm or less.

24. The magnetic alloy according to claim 1, wherein said magnetic alloy is obtained by heat-treating a fine crystalline alloy having a structure in which crystal grains having an average diameter of 30 nm or less are dispersed in an amorphous phase in a proportion of more than 3% by volume and 30% by volume or less.

25. The magnetic alloy according to claim 1, wherein said magnetic alloy has a coercivity of 12 A/m or less.

26. The magnetic alloy according to claim 6, wherein said magnetic alloy is obtained by heat-treating a fine crystalline alloy having a structure in which crystal grains having an average diameter of 30 nm or less are dispersed in an amorphous phase in a proportion of more than 3% by volume and 30% by volume or less.

27. The magnetic alloy according to claim 6, wherein said magnetic alloy has a coercivity of 12 A/m or less.

* * * * *